US007282134B2

(12) United States Patent
Abernathy et al.

(10) Patent No.: US 7,282,134 B2
(45) **Date of Patent: *Oct. 16, 2007**

(54) PROCESS FOR MANUFACTURING LUBRICATING BASE OIL WITH HIGH MONOCYCLOPARAFFINS AND LOW MULTICYCLOPARAFFINS

(75) Inventors: Susan M. Abernathy, Hercules, CA (US); David C. Kramer, San Anselmo, CA (US); John M. Rosenbaum, Richmond, CA (US); Stephen J. Miller, San Francisco, CA (US); Russell R. Krug, Novato, CA (US)

(73) Assignee: Chevron USA, Inc., Richmond, CA (US)

( * ) Notice: Subject to any disclaimer, the term of this patent is extended or adjusted under 35 U.S.C. 154(b) by 715 days.

This patent is subject to a terminal disclaimer.

(21) Appl. No.: 10/744,870

(22) Filed: Dec. 23, 2003

(65) Prior Publication Data

US 2005/0133409 A1 Jun. 23, 2005

(51) Int. Cl.
*C10G 73/38* (2006.01)
*C10G 71/00* (2006.01)
*C10M 101/00* (2006.01)

(52) U.S. Cl. ..... 208/18; 208/19; 208/27; 208/97; 208/950

(58) Field of Classification Search ..... 208/18, 208/19

See application file for complete search history.

(56) References Cited

U.S. PATENT DOCUMENTS 4,673,487 A * 6/1987 Miller ..... 208/58
5,082,986 A 1/1992 Miller
7,083,713 B2 * 8/2006 Abernathy et al. ..... 208/18
2003/0088133 A1 5/2003 O'Rear
2004/0108248 A1 6/2004 Cody et al.
2004/0108249 A1 6/2004 Cody et al.

FOREIGN PATENT DOCUMENTS

| | | |
|---|---|---|
| EP | 0 668 342 | 8/1995 |
| EP | 0 776 959 | 6/1997 |
| WO | WO 99/20720 | 4/1999 |
| WO | WO 00/14179 | 3/2000 |
| WO | WO 00/14183 | 3/2000 |
| WO | WO 00/14187 | 3/2000 |
| WO | WO01/57166 | 8/2001 |
| WO | WO 02/064710 | 8/2002 |
| WO | WO2004033606 | 4/2004 |
| WO | WO200481157 | 9/2004 |

OTHER PUBLICATIONS

"Product Brochure of Shell MDS (Malaysia) Sdn Bhd" dated May 1995.

* cited by examiner

*Primary Examiner*—Ellen M. McAvoy
(74) *Attorney, Agent, or Firm*—Susan Abernathy

(57) ABSTRACT

A process for manufacturing a lubricating base oil by: a) performing Fischer-Tropsch synthesis on syngas to provide a product stream; b) isolating from said product stream a substantially paraffinic wax feed having less than about 30 ppm total nitrogen and sulfur, and less than about 1 wt % oxygen; c) dewaxing said feed by hydroisomerization dewaxing using a shape selective intermediate pore size molecular sieve comprising a noble metal hydrogenation component, wherein the hydroisomerization temperature is between about 600° F. (315° C.) and about 750° F. (399° C.), to produce an is dimerized oil; and d) hydrofinishing said isomerized oil to produce a lubricating base oil having specific desired properties.

31 Claims, 4 Drawing Sheets

PROCESS FOR MANUFACTURING LUBRICATING BASE OIL WITH HIGH MONOCYCLOPARAFFINS AND LOW MULTICYCLOPARAFFINS

FIELD OF THE INVENTION

The invention relates to a process for manufacturing a lubricating base oil with the steps of: a) performing a Fischer-Tropsch synthesis on syngas to provide a product stream; b) isolating from said product stream a substantially paraffinic wax feed having less than about 30 ppm total combined nitrogen and sulfur, and less than about 1 wt % oxygen; c) dewaxing said substantially paraffinic wax feed by hydroisomerization dewaxing using a shape selective intermediate pore size molecular sieve with a noble metal hydrogenation component wherein the hydroisomerization temperature is between about 600° F. (315° C.) and about 750° F. (399° C.), whereby an isomerized oil is produced; and d) hydrofinishing said isomerized oil, whereby a lubricating base oil is produced having: a low weight percent of all molecules with at least one aromatic function, a high weight percent of all molecules with at least one cycloparaffin function, and a high ratio of weight percent of molecules containing monocycloparaffins to weight percent of molecules containing multicycloparaffins.

The process manufactures lubricating base oils with excellent oxidation stability, high viscosity index, good additive solubility, and good elastomer compatibility at higher yields than previously known processes.

BACKGROUND OF THE INVENTION

Finished lubricants and greases used for various applications, including automobiles, diesel engines, natural gas engines, axles, transmissions, and industrial applications consist of two general components, a lubricating base oil and additives. Lubricating base oil is the major constituent in these finished lubricants and contributes significantly to the properties of the finished lubricant. In general, a few lubricating base oils are used to manufacture a wide variety of finished lubricants by varying the mixtures of individual lubricating base oils and individual additives.

Highly saturated lubricating base oils in the prior art have either had very low levels of cycloparaffins; or when cycloparaffins were present, a significant amount of the cycloparaffins were multicycloparaffins. A certain amount of cycloparaffins are desired in lubricating base oils to provide additive solubility and elastomer compatibility. Multicycloparaffins are less desired than monocycloparaffins, because they decrease viscosity index, lower oxidation stability, and increase Noack volatility.

Examples of highly saturated lubricating base oils having very low levels of cycloparaffins are polyalphaolefins and base oils made from Fischer-Tropsch processes such as described in EPA1114124, EPA1114127, EPA1114131, EPA776959, EPA668342, and EPA1029029. Lubricating base oils in the prior art with high cycloparaffins made from Fischer-Tropsch wax have been described in WO 02/064710. The examples of the base oils in WO 02/064710 had very low pour points and the ratio of monocycloparaffins to multicycloparaffins was less than 15. The viscosity indexes of the lubricating base oils in WO 02/064710 were below 140. The Noack volatilities were between 6 and 14 weight percent. The lubricating base oils in WO 02/064710 were heavily dewaxed to achieve low pour points, which would produce reduced yields compared to oils that were not as heavily dewaxed.

The wax feed used to make the base oils in WO 02/064710 had a weight ratio of compounds having at least 60 or more carbon atoms and compounds having at least 30 carbon atoms greater than 0.20. These wax feeds are not as plentiful as feeds with lower weight ratios of compounds having at least 60 or more carbon atoms and compounds having at least 30 carbon atoms. The process in WO 02/064710 required an initial hydrocracking/hydroisomerizing of the wax feed, followed by a substantial pour reducing step. Lubricating base oil yield losses occurred at each of these two steps. To demonstrate this, in example 1 of WO 02/064710 the conversion of compounds boiling above 370° C. to compounds boiling below 370° C. was 55 wt % in the hydrocracking/hydroisomerization step alone. The subsequent pour reducing step would reduce the yield of products boiling above 370° C. further. Compounds boiling below 370° C. (700° F.) are typically not recovered as lubricating base oils due to their low viscosity. Because of the yield losses due to high conversions the process requires feeds with a high ratio of compounds having at least 60 or more carbon atoms and compounds having at least 30 carbon atoms.

Due to their high saturates content and low levels of cycloparaffins, lubricating base oils made from most Fischer-Tropsch processes or polyalphaolefins may exhibit poor additive solubility. Additives used to make finished lubricants typically have polar functionality; therefore, they may be insoluble or only slightly soluble in the lubricating base oil. To address the problem of poor additive solubility in highly saturated lubricating base oils with low levels of cycloparaffins, various co-solvents, such as synthetic esters, are currently used. However, these synthetic esters are very expensive, and thus, the blends of the lubricating base oils containing synthetic esters, which have acceptable additive solubility, are also expensive. The high price of these blends limits the current use of highly saturated lubricating base oils with low levels of cycloparaffins to specialized and small markets.

It has been taught in U.S. patent application Ser. No. 20030088133 that blends of lubricating base oils composed of 1) alkylated cycloparaffins with 2) highly paraffinic Fischer-Tropsch derived lubricating base oils improves the additive solubility of the highly paraffinic Fischer-Tropsch derived lubricating base oils. The lubricating base oils composed of alkylated cycloparaffins used in the blends of this application are very likely to also contain high levels of aromatics (greater than 30 weight percent), such that the resulting blends with Fischer-Tropsch derived lubricating base oils will contain a weight percent of all molecules with at least one aromatic function greater than 0.30. The high level of aromatics will cause reduced viscosity index and oxidation stability.

What is desired are lubricating base oils with very low amounts of aromatics, high amounts of monocycloparaffins, and little or no multicycloparaffins, that have a moderately low pour point such that they may be produced in high yield and provide good additive solubility and elastomer compatibility. Base oils with these qualities that also have good oxidation stability, high viscosity index, low Noack volatility, and good low temperature properties are also desired. The present invention provides these lubricating base oils.

What is desired is a process to make lubricating base oils with the desired properties detailed above that is not limited to wax feeds having a weight ratio of compounds having at least 60 or more carbon atoms and compounds having at least 30 carbon atoms of at least 0.2. What is also desired is a process for making lubricating base oils with the desired properties that may be accomplished with a single hydroisomerization dewaxing step that provides lower conversion of products boiling above 370° C. (700° F.+) to products boiling below 370° C. (700° F.−), and thus produces higher yields of lubricating base oil.

SUMMARY OF THE INVENTION

The present invention is directed to a process for manufacturing a lubricating base oil with the steps of: a) performing a Fischer-Tropsch synthesis on syngas to provide a product stream; b) isolating from said product stream a substantially paraffinic wax feed having less than about 30 ppm total combined nitrogen and sulfur and less than about 1 wt % oxygen; c) dewaxing said substantially paraffinic wax feed by hydroisomerization dewaxing using a shape selective intermediate pore size molecular sieve with a noble metal hydrogenation component, wherein the hydroisomerization temperature is between about 600° F. (315° C.) and about 750° F. (399° C.), whereby an isomerized oil is produced; and d) hydrofinishing said isomerized oil, whereby a lubricating base oil is produced having: a low weight percent of all molecules with at least one aromatic function, a high weight percent of all molecules with at least one cycloparaffin function, and a high ratio of weight percent molecules containing monocycloparaffins to weight percent of molecules containing multicycloparaffins.

Using the process of the invention, high yields of lubricating base oils are prepared with good additive solubility, good elastomer compatibility, excellent oxidation stability, and low volatility. In addition, the viscosity indexes are high. The lubricating base oils of the present invention may be used to prepare high quality finished lubricants, including automatic transmission fluids and multigrade engine oils, preferably without the addition of any ester co-solvent or viscosity index improver.

This invention overcomes shortcomings of the prior art that focused on reducing pour point and increasing total cycloparaffins in lubricating base oils made from Fisher-Tropsch wax. Producing base oils with very low pour points using hydroisomerization dewaxing may result in oils with high weight percents of all molecules with at least one cycloparaffin function, but at the expense of producing high weight percents of molecules containing multicycloparaffins as well. High weight percents of molecules containing multicycloparaffins reduce oxidation stability and viscosity index. Yields of lubricating base oil are also significantly reduced as hydroisomerization dewaxing severity is increased to obtain lower pour points. Producing base oils with very low pour points from Fischer-Tropsch wax using solvent dewaxing results in oils with lower weight percents of all molecules with at least one cycloparaffin function. A certain high amount of cycloparaffins is desired to improve the additive solubility and elastomer compatibility of the lubricating base oil.

This invention overcomes shortcomings of the prior art that focused on processes to increase viscosity index in lubricating base oils made from substantially paraffinic wax feed wherein the substantially paraffinic wax feed has less than about 30 ppm total combined nitrogen and sulfur, and an oxygen content less than about 1 weight percent. High viscosity index in the prior art lubricating base oils has been obtained by including a substantial amount of solvent dewaxing, which produces reduced amounts of total cycloparaffins compared to hydroisomerization dewaxing. High viscosity index in the prior art was also obtained by a process using relatively narrow boiling Fischer-Tropsch feed with a T90-T10 between 40 to 150° C. This invention produces lubricating base oils with high viscosity indexes using Fischer-Tropsch feeds with both narrow boiling and wide boiling point distributions.

The very low amount of aromatics in the lubricating base oil provides excellent oxidation stability and high viscosity index. The high amount of all molecules with at least one cycloparaffin function provides improved additive solubility and elastomer compatibility to the lubricating base oil. The very high ratio of weight percent of molecules containing monocycloparaffins to weight percent of molecules containing multicycloparaffins (or high weight percent of molecules containing monocycloparaffins and little to no weight percent of molecules containing multicycloparaffins) optimizes the composition of the cycloparaffins. Molecules containing multicycloparaffins are less desired as they dramatically reduce the viscosity index, oxidation stability, and Noack volatility of lubricating base oils.

The present invention is also directed to a lubricating base oil manufacturing plant comprising: a) a means to produce a substantially paraffinic wax feed having less than about 30 ppm total combined nitrogen and sulfur, less than about 1 weight percent oxygen, greater than about 75 mass percent normal paraffin, less than 10 weight percent oil, a weight ratio of compounds having at least 60 or more carbon atoms and compounds having at least 30 carbon atoms less than 0.18, and a T90 boiling point between 660° F. and 1200° F.; b) a means for hydroisomerization dewaxing said substantially paraffinic wax feed using a shape selective intermediate pore size molecular sieve comprising a noble metal hydrogenation component, wherein the hydroisomerization temperature is between about 600° F. (315° C.) and about 750° F. (399° C.), to produce an isomerized oil; and c) a means for hydrofinishing the isomerized oil to produce lubricating base oils having low weight percents of all molecules with at least one aromatic function, high weight percents of all molecules with at least one cycloparaffin function, and a high ratio of weight percent of molecules containing monocycloparaffins to weight percent of molecules containing multicycloparaffins.

$$\text{Base Oil Pour Factor} = 7.35 \times \text{Ln}(\text{Kinematic Viscosity at } 100^\circ\text{ C.}) - 18,$$

wherein Ln(Kinematic Viscosity at 100° C.) is the natural logarithm with base "e" of Kinematic Viscosity at 100° C. in cSt.

Figure 2:
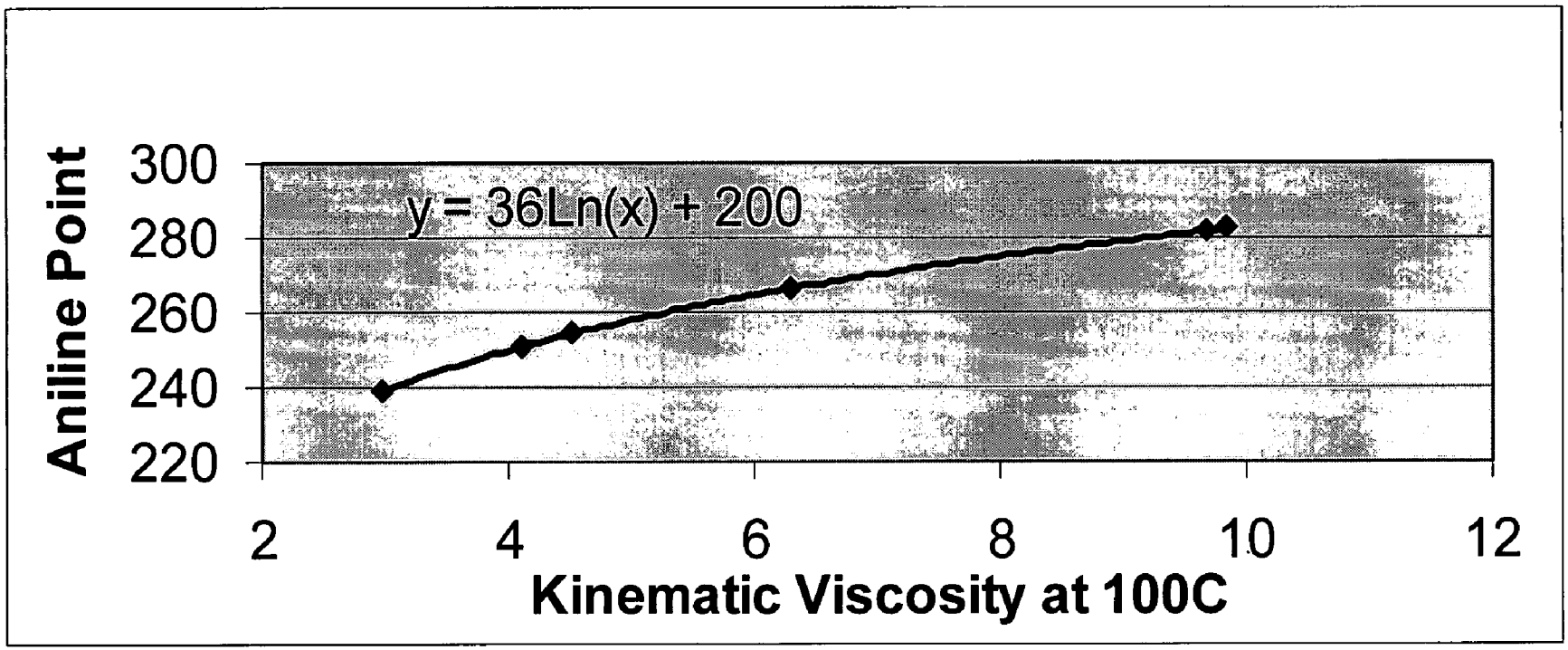

FIG. 2 illustrates the plots of Kinematic Viscosity at 100° C. in cSt vs. Aniline Point in ° F., providing the equation for calculation of the preferred Aniline Point upper limits based on Kinematic Viscosity:

$$\text{Aniline Point, in degrees Fahrenheit} = 36 \times \text{Ln}(\text{Kinematic Viscosity at } 100^\circ\text{ C.}) + 200,$$

wherein Ln(Kinematic Viscosity at 100° C.) is the natural logarithm with base "e" of Kinematic Viscosity at 100° C. in cSt.

Figure 3:
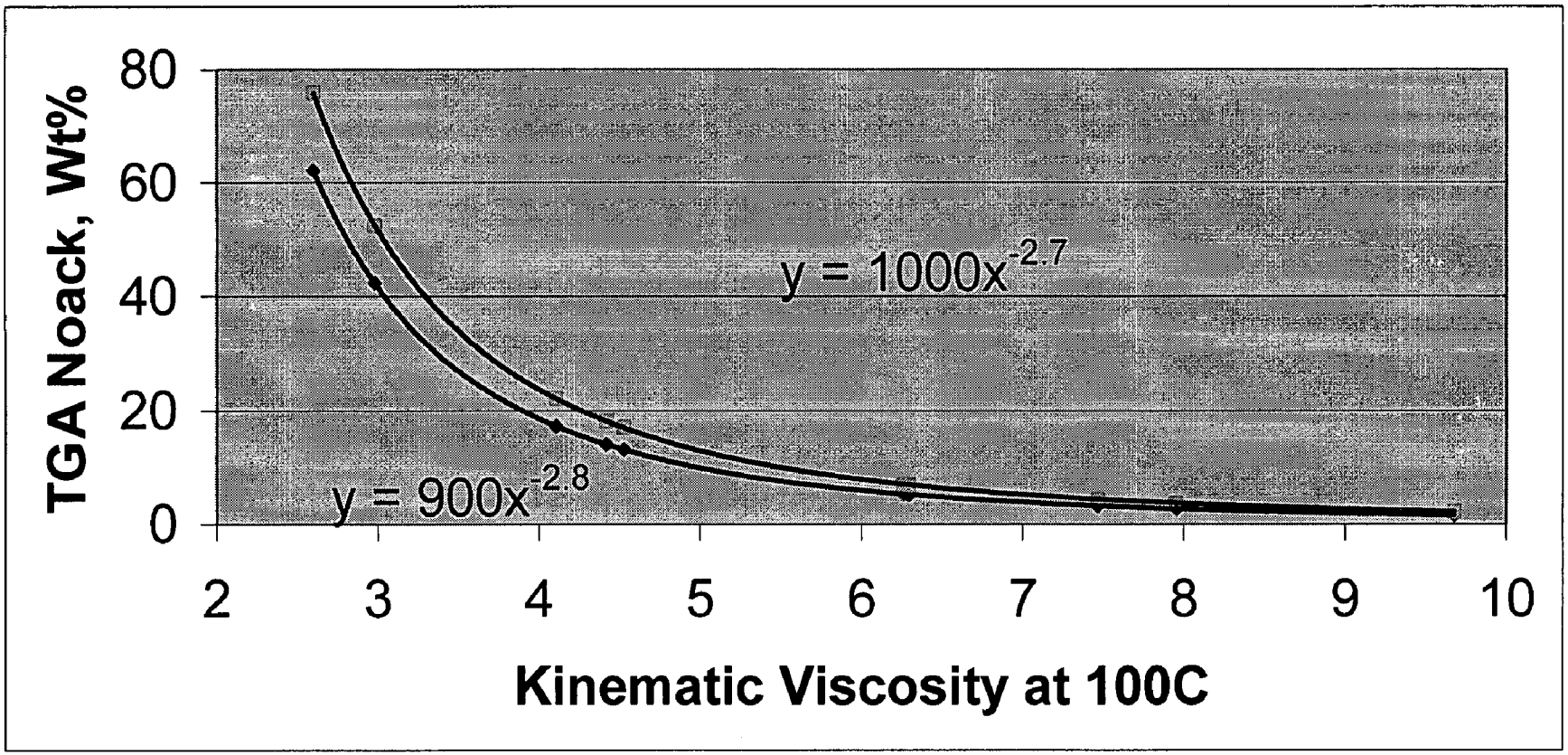

FIG. 3 illustrates the plots of Kinematic Viscosity at 100° C. vs. TGA Noack in Weight percent, providing the equations for calculation of the preferred Noack Volatility upper limits based on Kinematic Viscosity:

Noack Volatility, Wt %=1000×(Kinematic Viscosity at 100° C. in cSt)$^{-2.7}$, wherein the Kinematic Viscosity at 100° C. is raised to the power of −2.7; and Noack Volatility, Wt %=900×(Kinematic Viscosity at 100° C. in cSt)$^{-2.8}$, wherein the Kinematic Viscosity at 100° C. is raised to the power of −2.8.

Figure 4:
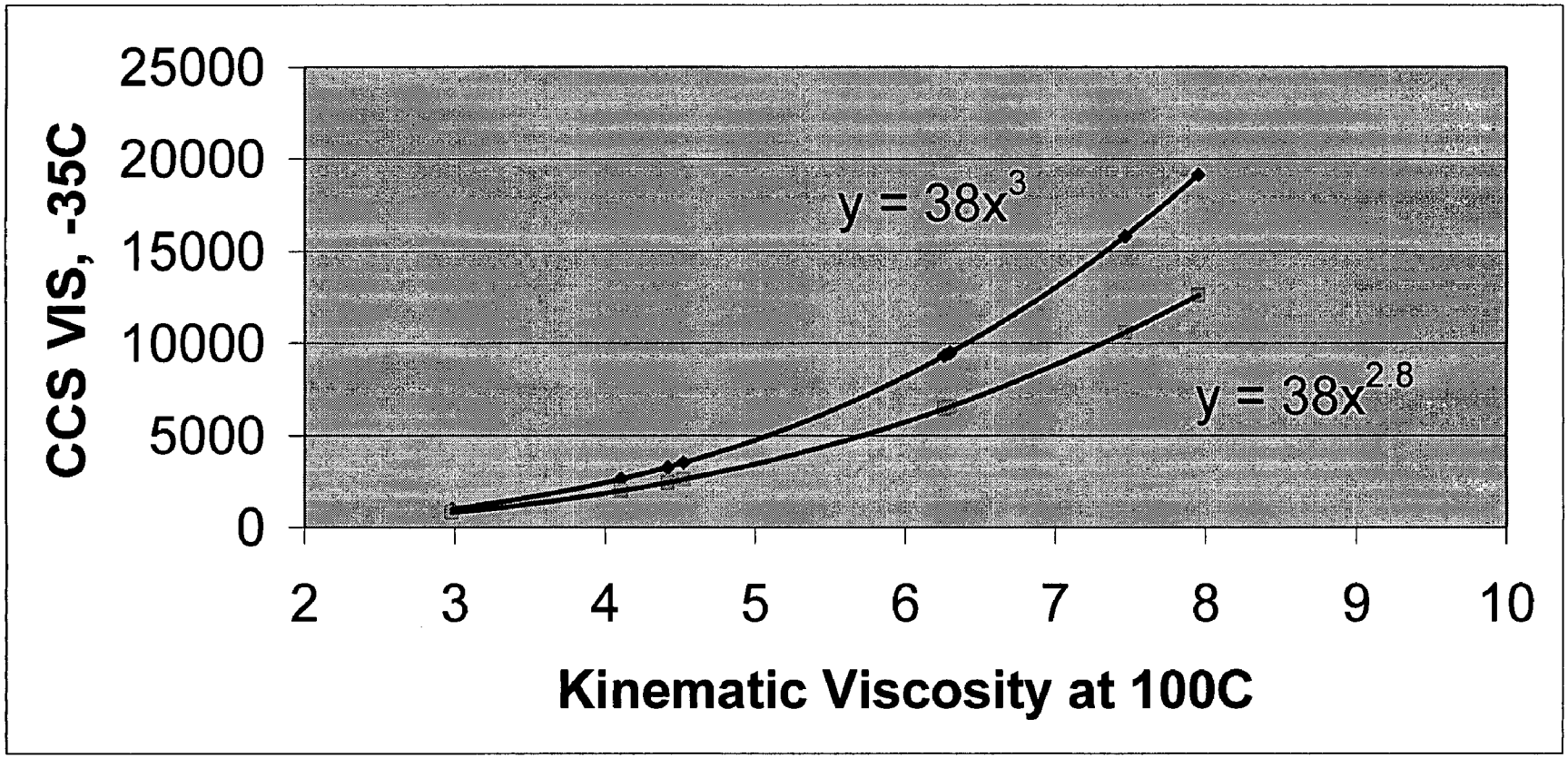

FIG. 4 illustrates the plots of Kinematic Viscosity at 100° C. in cSt vs. CCS Viscosity at −35° C., in cP, providing the equations for calculation of the preferred CCS VIS (−35° C.) upper limits based on Kinematic Viscosity:

CCS VIS (−35° C.), cP=38×(Kinematic Viscosity at 100° C.)$^{3}$, wherein the Kinematic Viscosity at 100° C. in cSt is raised to the power of 3; and CCS VIS (−35° C.), cP=38×(Kinematic Viscosity at 100° C.)$^{2.8}$, wherein the Kinematic Viscosity at 100° C. in cSt is raised to the power of 2.8.

DETAILED DESCRIPTION OF THE INVENTION

Lubricating base oils with very low aromatic content made prior to this invention have either had very low cycloparaffin content, or high cycloparaffin content with considerable levels of multicycloparaffins and/or very low pour points. The highest known ratio of monocycloparaffins to multicycloparaffins in lubricating base oils containing greater than 10 weight percent cycloparaffins and low aromatics content; was 13:1. The lubricating base oil with this high ratio was the base oil Example 3 from WO 02/064710. The pour point of this example base oil was extremely low, −45° C., indicating that it was severely dewaxed. Severe dewaxing of base oils to low pour points are made at a significant yield disadvantage compared to lubricating base oils dewaxed to more moderate pour points.

Lubricating base oils containing cycloparaffins are desired as cycloparaffins impart additive solubility and elastomer compatibility to these oils. Lubricating base oils containing very high ratios of monocycloparaffins to multicycloparaffins (or high monocycloparaffins and little to no multicycloparaffins) are also desired as the multicycloparaffins reduce oxidation stability, lower viscosity index, and increase Noack volatility. Models of the effects of multicycloparaffins are given in V. J. Gatto, et al, "The Influence of Chemical Structure on the Physical Properties and Antioxidant Response of Hydrocracked Base Stocks and Polyalphaolefins," J. Synthetic Lubrication 19-1, April 2002, pp 3-18.

By virtue of the present invention, lubricating base oils are made which have very low weight percents of all molecules with at least one aromatic function, high weight percents of all molecules with at least one cycloparaffin function, and high ratios of weight percent of molecules containing monocycloparaffins to weight percent of molecules containing multicycloparaffins (or high weight percent of molecules containing monocycloparaffins and very low weight percents of molecules containing multicycloparaffins). In preferred embodiments they will also have moderate pour points. Moderate pour points are achieved by producing oils with a ratio of pour point to kinematic viscosity at 100° C. greater than a Base Oil Pour Factor, defined herein. High yields of these base oils may be obtained using a process comprising the steps of: a) performing a Fischer-Tropsch synthesis to provide a product stream, b) isolating from the product stream a substantially paraffinic wax feed having less than about 30 ppm total combined nitrogen and sulfur, and less than about 1 weight percent oxygen, c) dewaxing said substantially paraffinic wax feed by hydroisomerization dewaxing using a shape selective intermediate pore size molecular sieve comprising a noble metal hydrogenation component, whereby an isomerized oil is produced, and d) hydrofinishing said isomerized oil whereby a lubricating base oil is produced having a weight percent of all molecules with at least one aromatic function less than 0.30, a weight percent of all molecules with at least one cycloparaffin function greater than 10, and a high ratio of weight percent of molecules containing monocycloparaffins to weight percent of molecules containing multicycloparaffins (greater than 15).

Alternatively, step d) of the above process may be changed to: d) hydrofinishing said isomerized oil whereby a lubricating base oil is produced having a weight percent of all molecules with at least one aromatic function less than 0.30, a weight percent of all molecules with at least one cycloparaffin function greater than the kinematic viscosity at 100° C. in cSt multiplied by three, and a ratio of weight percent of molecules containing monocycloparaffins to weight percent of molecules containing multicycloparaffins greater than 15.

As a second alternative, step d) of the above process may be changed to: c) hydrofinishing said isomerized oil whereby a lubricating base oil is produced having a weight percent of all molecules with at least one aromatic function less than 0.30, a weight percent of molecules containing monocycloparaffins greater than 10, a weight percent of molecules containing multicycloparaffins less than 0.1.

Kinematic viscosity is a measurement of the resistance to flow of a fluid under gravity. Many lubricating base oils, finished lubricants made from them, and the correct operation of equipment depends upon the appropriate viscosity of the fluid being used. Kinematic viscosity is determined by ASTM D 445-01. The results are reported in centistokes (cSt). The kinematic viscosities of the lubricating base oils made by the processes of this invention are between about 2 cSt and about 20 cSt, preferably between about 2 cSt and about 12 cSt.

Pour point is a measurement of the temperature at which the sample will begin to flow under carefully controlled conditions. Pour point may be determined as described in ASTM D 5950-02. The results are reported in degrees Celsius. Many commercial lubricating base oils have specifications for pour point. When lubricant base oils have low pour points, they also are likely to have other good low temperature properties, such as low cloud point, low cold filter plugging point, and low temperature cranking viscosity. Cloud point is a measurement complementary to the pour point, and is expressed as a temperature at which a sample of the lubricant base oil begins to develop a haze under carefully specified conditions. Cloud point may be determined by, for example, ASTM D 5773-95. Lubricating base oils having pour-cloud point spreads below about 35° C. are also desirable. Higher pour-cloud point spreads require processing the lubricating base oil to very low pour points in order to meet cloud point specifications. The pour-cloud point spreads of the lubricating base oils of this invention are generally less than about 35° C., preferably less than about 25° C., more preferably less than about 10° C. The cloud points are generally in the range of +30 to −30° C.

Noack volatility of engine oil, as measured by TGA Noack and similar methods, has been found to correlate with oil consumption in passenger car engines. Strict requirements for low volatility are important aspects of several recent engine oil specifications, such as, for example, ACEA A-3 and B-3 in Europe, and SAE J300-01 and ILSAC GF-3 in North America. Any new lubricating base oil developed for use in automotive engine oils should have a Noack volatility no greater than current conventional Group I or Group II Light Neutral oils. The Noack volatility of the lubricating base oils of this invention are very low, generally less than an amount calculated by the equation:

Noack Volatility, Wt %=1000×(Kinematic Viscosity at 100° C.)$^{-2.7}$. In preferred embodiments the Noack volatility is less than an amount calculated by the equation:

Noack Volatility, Wt %=900×(Kinematic Viscosity at 100° C.)$^{-2.8}$.

Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D 5800). A more convenient method for calculating Noack volatility and one which correlates well with ASTM D-5800 is by using a thermo gravimetric analyzer test (TGA) by ASTM D-6375-99. TGA Noack volatility is used throughout this disclosure unless otherwise stated.

The lubricating base oils of this invention may be blended with other base oils to improve or modify their properties (e.g., viscosity index, oxidation stability, pour point, sulfur content, traction coefficient, or Noack volatility). Examples of base oils that may be blended with the lubricating base oils of this invention are conventional Group I base oils, conventional Group II base oils, conventional Group III base oils, other GTL base oils, isomerized petroleum wax, polyalphaolefins, polyinternalolefins, oligomerized olefins from Fischer-Tropsch derived feed, diesters, polyol esters, phosphate esters, alkylated aromatics, alkylated cycloparaffins, and mixtures thereof.

Wax Feed:

The wax feed used to make the lubricating base oil of this invention is substantially paraffinic with less than about 30 ppm total combined nitrogen and sulfur. The level of oxygen is less than about 1 weight percent, preferably less than 0.6 weight percent, more preferably less than 0.2 weight percent. In most cases, the level of oxygen in the substantially paraffinic wax feed will be between 0.01 and 0.90 weight percent. The oil content of the feed is less than 10 weight percent as determined by ASTM D 721. Substantially paraffinic for the purpose of this invention is defined as having greater than about 75 mass percent normal paraffin by gas chromatographic analysis by ASTM D 5442.

Nitrogen Determination:

Nitrogen is measured by melting the substantially paraffinic wax feed prior to oxidative combustion and chemiluminescence detection by ASTM D 4629-96. The test method is further described in U.S. Pat. No. 6,503,956, incorporated herein in its entirety.

Sulfur Determination:

Sulfur is measured by melting the substantially paraffinic wax feed prior to ultraviolet fluorescence by ASTM 5453-00. The test method is further described in U.S. Pat. No. 6,503,956.

Oxygen Determination:

Oxygen is measured by neutron activation analysis.

The wax feed useful in this invention has a significant fraction with a boiling point greater than 650° F. (343° C.). The T90 boiling points of the wax feed by ASTM D 6352 are preferably between 660° F. (349° C.) and 1200° F. (649° C.), more preferably between 900° F. (482° C.) and 1200° F. (649° C.), most preferably between 1000° F. (538° C.) and 1200° F. (649° C.). T90 refers to the temperature at which 90 weight percent of the feed has a lower boiling point.

The wax feed preferably has a weight ratio of molecules of at least 60 carbons to molecules of at least 30 carbons less than 0.18. The weight ratio of molecules of at least 60 carbons to molecules of at least 30 carbons is determined by: 1) measuring the boiling point distribution of the Fischer-Tropsch wax by simulated distillation using ASTM D 6352; 2) converting the boiling points to percent weight distribution by carbon number, using the boiling points of n-paraffins published in Table 1 of ASTM D 6352-98; 3) summing the weight percents of products of carbon number 30 or greater; 4) summing the weight percents of products of carbon number 60 or greater; 5) dividing the sum of weight percents of products of carbon number 60 or greater by the sum of weight percents of products of carbon number 30 or greater. Other preferred embodiments of this invention use Fischer-Tropsch wax having a weight ratio of molecules having at least 60 carbons to molecules having at least 30 carbons less than 0.15, or less than 0.10.

The boiling range distribution of the wax feed useful in the process of this invention may vary considerably. For example the difference between the T90 and T10 boiling points, determined by ASTM D 6352, may be greater than 95° C., greater than 160° C., greater than 200° C., or even greater than 225° C.

Fischer-Tropsch Synthesis and Fischer-Tropsch Wax

A preferred wax feed for this process is Fischer-Tropsch wax. Fischer-Tropsch wax is a product of Fischer-Tropsch synthesis. During Fischer-Tropsch synthesis liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 degrees to about 700 degrees F. (about 150 degrees to about 370 degrees C.) preferably from about 400 degrees to about 550 degrees F. (about 205 degrees to about 230 degrees C.); pressures of from about 10 to about 600 psia, (0.7 to 41 bars) preferably 30 to 300 psia, (2 to 21 bars) and catalyst space velocities of from about 100 to about 10,000 cc/g/hr., preferably 300 to 3,000 cc/g/hr.

The products from the Fischer-Tropsch synthesis may range from $C_1$ to $C_{200}$ plus hydrocarbons, with a majority in the $C_5$-$C_{100}$ plus range. Fischer-Tropsch synthesis may be viewed as a polymerization reaction. Applying polymerization kinetics, a simple one parameter equation can describe the entire product distribution, referred to as the Anderson-Shultz-Flory (ASF) distribution:

$$W_n=(1-\alpha)^2\times n\times\alpha^{n-1}$$

Where $W_n$ is the weight fraction of product with carbon number n, and $\alpha$ is the ASF chain growth probability. The higher the value of $\alpha$, the longer the average chain length. The ASF chain growth probability of the $C_{20}$+ fraction of the Fischer-Tropsch wax of this invention is between about 0.85 and about 0.915.

The Fischer-Tropsch reaction can be conducted in a variety of reactor types, such as, for example, fixed bed reactors containing one or more catalyst beds, slurry reactors, fluidized bed reactors, or a combination of different types of reactors. Such reaction processes and reactors are well known and documented in the literature. The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, also completely incorporated herein by reference for all purposes.

Suitable Fischer-Tropsch catalysts comprise one or more Group VIII catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as ThO2, La2O3, MgO, and TiO2, promoters such as ZrO2, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania, or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Hydroisomerization Dewaxing

According to the present invention, the substantially paraffinic wax feed is dewaxed by hydroisomerization dewaxing at conditions sufficient to produce lubricating base oil with a desired composition of cycloparaffins and a moderate pour point. In general, conditions for hydroisomerization dewaxing in the present invention is controlled to temperatures between about 600° F. (315° C.) and about 750° F. (399° C.) such that the conversion of the compounds boiling above about 700° F. in the wax feed to compounds boiling below about 700° F. is maintained between about 10 wt % and 50 wt %, preferably between 15 wt % and 45 wt %. Hydroisomerization dewaxing is intended to improve the cold flow properties of a lubricating base oil by the selective addition of branching into the molecular structure. Hydroisomerization dewaxing ideally will achieve high conversion levels of waxy feed to non-waxy iso-paraffins while at the same time minimizing the conversion by cracking.

Hydroisomerization is conducted using a shape selective intermediate pore size molecular sieve. Hydroisomerization catalysts useful in the present invention comprise a shape selective intermediate pore size molecular sieve and a catalytically active metal hydrogenation component on a refractory oxide support. The phrase "intermediate pore size," as used herein means a crystallographic free diameter in the range of from about 3.9 to about 7.1 Angstrom when the porous inorganic oxide is in the calcined form. The shape selective intermediate pore size molecular sieves used in the practice of the present invention are generally 1-D 10-, 11- or 12-ring molecular sieves. The most preferred molecular sieves of the invention are of the 1-D 10-ring variety, where 10-(or 11- or 12-) ring molecular sieves have 10 (or 11 or 12) tetrahedrally-coordinated atoms (T-atoms) joined by oxygens. In the 1-D molecular sieve, the 10-ring (or larger) pores are parallel with each other, and do not interconnect. Note, however, that 1-D 10-ring molecular sieves which meet the broader definition of the intermediate pore size molecular sieve but include intersecting pores having 8-membered rings may also be encompassed within the definition of the molecular sieve of the present invention. The classification of intrazeolite channels as 1-D, 2-D and 3-D is set forth by R. M. Barrer in Zeolites, Science and Technology, edited by F. R. Rodrigues, L. D. Rollman and C. Naccache, NATO ASI Series, 1984 which classification is incorporated in its entirety by reference (see particularly page 75).

Preferred shape selective intermediate pore size molecular sieves used for hydroisomerization dewaxing are based upon aluminum phosphates, such as SAPO-11, SAPO-31, and SAPO-41. SAPO-11 and SAPO-31 are more preferred, with SAPO-11 being most preferred. SM-3 is a particularly preferred shape selective intermediate pore size SAPO, which has a crystalline structure falling within that of the SAPO-11 molecular sieves. The preparation of SM-3 and its unique characteristics are described in U.S. Pat. Nos. 4,943,424 and 5,158,665. Also preferred shape selective intermediate pore size molecular sieves used for hydroisomerization dewaxing are zeolites, such as ZSM-22, ZSM-23, ZSM-35, ZSM-48, ZSM-57, SSZ-32, offretite, and ferrierite. SSZ-32 and ZSM-23 are more preferred.

A preferred intermediate pore size molecular sieve is characterized by selected crystallographic free diameters of the channels, selected crystallite size (corresponding to selected channel length), and selected acidity. Desirable crystallographic free diameters of the channels of the molecular sieves are in the range of from about 3.9 to about 7.1 Angstrom, having a maximum crystallographic free diameter of not more than 7.1 and a minimum crystallographic free diameter of not less than 3.9 Angstrom. Preferably the maximum crystallographic free diameter is not more than 7.1 and the minimum crystallographic free diameter is not less than 4.0 Angstrom. Most preferably the maximum crystallographic free diameter is not more than 6.5 and the minimum crystallographic free diameter is not less than 4.0 Angstrom. The crystallographic free diameters of the channels of molecular sieves are published in the "Atlas of Zeolite Framework Types", Fifth Revised Edition, 2001, by Ch. Baerlocher, W. M. Meier, and D. H. Olson, Elsevier, pp 10-15, which is incorporated herein by reference.

If the crystallographic free diameters of the channels of a molecular sieve are unknown, the effective pore size of the molecular sieve can be measured using standard adsorption techniques and hydrocarbonaceous compounds of known minimum kinetic diameters. See Breck, Zeolite Molecular Sieves, 1974 (especially Chapter 8); Anderson et al. J. Catalysis 58, 114 (1979); and U.S. Pat. No. 4,440,871, the pertinent portions of which are incorporated herein by reference. In performing adsorption measurements to determine pore size, standard techniques are used. It is convenient to consider a particular molecule as excluded if does not reach at least 95% of its equilibrium adsorption value on the molecular sieve in less than about 10 minutes (p/po=0.5; 25° C.). Intermediate pore size molecular sieves will typically admit molecules having kinetic diameters of 5.3 to 6.5 Angstrom with little hindrance.

Preferred hydroisomerization dewaxing catalysts useful in the present invention have sufficient acidity so that 0.5 grams thereof when positioned in a tube reactor converts at least 50% of hexadecane at 370° C., pressure of 1200 psig, a hydrogen flow of 160 ml/min, and a feed rate of 1 ml/hr. The catalyst also exhibits isomerization selectivity of 40 percent or greater (isomerization selectivity is determined as follows: 100×(weight % branched $C_{16}$ in product)/(weight % branched $C_{16}$ in product+weight % $C_{13-}$ in product) when used under conditions leading to 96% conversion of normal hexadecane (n-$C_{16}$) to other species.

Hydroisomerization dewaxing catalysts useful in the present invention comprise a catalytically active hydrogenation noble metal. The presence of a catalytically active hydrogenation metal leads to product improvement, especially viscosity index and stability. The noble metals platinum and palladium are especially preferred, with platinum most especially preferred. If platinum and/or palladium is used, the total amount of active hydrogenation metal is typically in the range of 0.1 to 5 weight percent of the total catalyst, usually from 0.1 to 2 weight percent, and not to exceed 10 weight percent.

The refractory oxide support may be selected from those oxide supports which are conventionally used for catalysts, including silica, alumina, silica-alumina, magnesia, titania, and combinations thereof.

The conditions for hydroisomerization dewaxing depend on the feed used, the catalyst used, whether or not the catalyst is sulfided, the desired yield, and the desired properties of the lubricant base oil. Conditions under which the hydroisomerization process of the current invention may be carried out include temperatures from about 600° F. to about 750° F. (315° C. to about 399° C.), preferably about 650° F. to about 700° F. (343° C. to about 371° C.); and pressures from about 15 to 3000 psig, preferably 100 to 2500 psig. The hydroisomerization dewaxing pressures in this context refer to the hydrogen partial pressure within the hydroisomerization reactor, although the hydrogen partial pressure is substantially the same (or nearly the same) as the total pressure. The liquid hourly space velocity during contacting is generally from about 0.1 to 20 hr-1, preferably from about 0.1 to about 5 hr-1. The hydrogen to hydrocarbon ratio falls within a range from about 1.0 to about 50 moles $H_2$ per mole hydrocarbon, more preferably from about 10 to about 20 moles $H_2$ per mole hydrocarbon.

Suitable conditions for performing hydroisomerization are described in U.S. Pat. Nos. 5,282,958 and 5,135,638, the contents of which are incorporated by reference in their entirety.

Hydrogen is present in the reaction zone during the hydroisomerization dewaxing process, typically in a hydrogen to feed ratio from about 0.5 to 30 MSCF/bbl (thousand standard cubic feet per barrel), preferably from about 1 to about 10 MSCF/bbl. Generally, hydrogen will be separated from the product and recycled to the reaction zone.

Hydrotreating and Hydrofinishing

Hydrotreating refers to a catalytic process, usually carried out in the presence of free hydrogen, in which the primary purpose is the removal of various metal contaminants, such as arsenic, aluminum, and cobalt; heteroatoms, such as sulfur and nitrogen; oxygenates; or aromatics from the feed stock. Generally, in hydrotreating operations cracking of the hydrocarbon molecules, i.e., breaking the larger hydrocarbon molecules into smaller hydrocarbon molecules, is minimized, and the unsaturated hydrocarbons are either fully or partially hydrogenated. Waxy feed to the process of this invention is preferably hydrotreated prior to hydroisomerization dewaxing.

Catalysts used in carrying out hydrotreating operations are well known in the art. See for example U.S. Pat. Nos. 4,347,121 and 4,810,357, the contents of which are hereby incorporated by reference in their entirety, for general descriptions of hydrotreating, hydrocracking, and of typical catalysts used in each of the processes. Suitable catalysts include noble metals from Group VIIIA (according to the 1975 rules of the International Union of Pure and Applied Chemistry), such as platinum or palladium on an alumina or siliceous matrix, and Group VIII and Group VIB, such as nickel-molybdenum or nickel-tin on an alumina or siliceous matrix. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals, such as nickel-molybdenum, are usually present in the final catalyst composition as oxides, but are usually employed in their reduced or sulfided forms when such sulfide compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

Typical hydrotreating conditions vary over a wide range. In general, the overall LHSV is about 0.25 to 2.0, preferably about 0.5 to 1.5. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures in the reactor will range from about 300 degrees F. to about 750 degrees F. (about 150 degrees C. to about 400 degrees C.), preferably ranging from 450 degrees F. to 725 degrees F. (230 degrees C. to 385 degrees C.).

Hydrotreating is used as a step following hydroisomerization dewaxing in the lubricant base oil manufacturing process of this invention. This step, herein called hydrofinishing, is intended to improve the oxidation stability, UV stability, and appearance of the product by removing traces of aromatics, olefins, color bodies, and solvents. As used in this disclosure, the term UV stability refers to the stability of the lubricating base oil or the finished lubricant when exposed to UV light and oxygen. Instability is indicated when a visible precipitate forms, usually seen as floc or cloudiness, or a darker color develops upon exposure to ultraviolet light and air. A general description of hydrofinishing may be found in U.S. Pat. Nos. 3,852,207 and 4,673,487. Clay treating to remove these impurities is an alternative final process step.

Fractionation:

Optionally, the process of this invention may include fractionating of the substantially paraffinic wax feed prior to hydroisomerization dewaxing, or fractionating of the lubricating base oil. The fractionation of the substantially paraffinic wax feed or lubricating base oil into distillate fractions is generally accomplished by either atmospheric or vacuum distillation, or by a combination of atmospheric and vacuum distillation. Atmospheric distillation is typically used to separate the lighter distillate fractions, such as naphtha and middle distillates, from a bottoms fraction having an initial boiling point above about 600 degrees F. to about 750 degrees F. (about 315 degrees C. to about 399 degrees C.). At higher temperatures thermal cracking of the hydrocarbons may take place leading to fouling of the equipment and to lower yields of the heavier cuts. Vacuum distillation is typically used to separate the higher boiling material, such as the lubricating base oil fractions, into different boiling range cuts. Fractionating the lubricating base oil into different boiling range cuts enables the lubricating base oil manufacturing plant to produce more than one grade, or viscosity, of lubricating base oil.

Solvent Dewaxing:

Solvent dewaxing may be optionally used to remove small amounts of remaining waxy molecules from the lubricating base oil after hydroisomerization dewaxing. Solvent dewaxing is done by dissolving the lubricating base oil in a solvent, such as methyl ethyl ketone, methyl isobutyl ketone, or toluene, and precipitating the wax molecules as discussed in Chemical Technology of Petroleum, 3rd Edition, William Gruse and Donald Stevens, McGraw-Hill Book Company, Inc., New York, 1960, pages 566 to 570. See also U.S. Pat. Nos. 4,477,333, 3,773,650 and 3,775,288.

Lubricating Base Oil Hydrocarbon Composition:

The lubricating base oils of this invention have greater than 95 weight percent saturates as determined by elution column chromatography, ASTM D 2549-02. Olefins are present in amounts less than detectable by long duration $C^{13}$ Nuclear Magnetic Resonance Spectroscopy (NMR). Molecules with at least one aromatic function are present in amounts less than 0.3 weight percent by HPLC-UV, and confirmed by ASTM D 5292-99 modified to measure low level aromatics. In preferred embodiments molecules with at least one aromatic function are present in amounts less than 0.10 weight percent, preferably less than 0.05 weight percent, and more preferably less than 0.01 weight percent. Sulfur is present in amounts less than 25 ppm, more preferably less than 1 ppm as determined by ultraviolet fluorescence by ASTM D 5453-00.

Aromatics Measurement by HPLC-UV:

The method used to measure low levels of molecules with at least one aromatic function in the lubricating base oils of this invention uses a Hewlett Packard 1050 Series Quaternary Gradient High Performance Liquid Chromatography (HPLC) system coupled with a HP 1050 Diode-Array UV-Vis detector interfaced to an HP Chem-station. Identification of the individual aromatic classes in the highly saturated lubricating base oils was made on the basis of their UV spectral pattern and their elution time. The amino column used for this analysis differentiates aromatic molecules largely on the basis of their ring-number (or more correctly, double-bond number). Thus, the single ring aromatic containing molecules would elute first, followed by the polycyclic aromatics in order of increasing double bond number per molecule. For aromatics with similar double bond character, those with only alkyl substitution on the ring would elute sooner than those with naphthenic substitution.

Unequivocal identification of the various base oil aromatic hydrocarbons from their UV absorbance spectra was somewhat complicated by the fact their peak electronic transitions were all red-shifted relative to the pure model compound analogs to a degree dependent on the amount of alkyl and naphthenic substitution on the ring system. These bathochromic shifts are well known to be caused by alkyl-group delocalization of the $\pi$-electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic. Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricating base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beer's law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricating base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricating base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricating base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Cycloparaffin Distribution by FIMS:

Paraffins are considered more stable than cycloparaffins towards oxidation, and therefore, more desirable. Monocycloparaffins are considered more stable than multicycloparaffins towards oxidation. However, when the weight percent of all molecules with at least one cycloparaffin function is very low in a lubricating base oil, the additive solubility is low and the elastomer compatibility is poor. Examples of base oils with these properties are polyalphaolefins and Fischer-Tropsch base oils with less than about 5% cycloparaffins. To improve these properties in finished lubricants, expensive co-solvents such as esters must often be added. There is achieved by this invention lubricating base oils with a high weight percent of molecules containing monocycloparaffins and a low weight percent of molecules containing multicycloparaffins such that they have high oxidation stability and high viscosity index in addition to good additive solubility and elastomer compatibility.

The distribution of the saturates (n-paraffin, iso-paraffin, and cycloparaffins) in lubricating base oils of this invention is determined by field ionization mass spectroscopy (FIMS). FIMS spectra were obtained on a VG 70VSE mass spectrometer. The samples were introduced via a solid probe, which was heated from about 40° C. to 500° C. at a rate of 50° C. per minute. The mass spectrometer was scanned from m/z 40 to m/z 1000 at a rate of 5 seconds per decade. The acquired mass spectra were summed to generate one "averaged" spectrum. Each spectrum was $C_{13}$ corrected using a software package from PC-MassSpec. FIMS ionization efficiency was evaluated using blends of nearly pure branched paraffins and highly naphthenic, aromatics-free base stock. The ionization efficiencies of iso-paraffins and cycloparaffins in these base oils were essentially the same. Iso-paraffins and cycloparaffins comprise more than 99.9% of the saturates in the lubricating base oils of this invention.

The lubricating base oils of this invention are characterized by FIMS into paraffins and cycloparaffins containing different numbers of rings. Monocycloparaffins contain one ring, dicycloparaffins contain two rings, tricycloparaffins contain three rings, tetracycloparaffins contain four rings, pentacycloparaffins contain five rings, and hexacycloparaffins contain six rings. Cycloparaffins with more than one ring are referred to as multicycloparaffins in this invention.

In one embodiment, the lubricating base oils of this invention have a weight percent of all molecules with at least one cycloparaffin function greater than 10, preferably greater than 15, more preferably greater than 20. They have a ratio of weight percent of molecules containing monocycloparaffins to weight percent of molecules containing multicycloparaffins greater than 15, preferably greater than 50, more preferably greater than 100. The most preferred lubricating base oils of this invention have a weight percent of molecules containing monocycloparaffins greater than 10, and a weight percent of molecules containing multicycloparaffins less than 0.1, or even no molecules containing multicycloparaffins. In this embodiment, the lubricating base oils may have a kinematic viscosity at 100° C. between about 2 cSt and about 20 cSt, preferably between about 2 cSt and about 12 cSt, most preferably between about 3.5 cSt and about 12 cSt.

In another embodiment of this invention there is a relationship between the weight percent of all molecules with at least one cycloparaffin function and the kinematic viscosity of the lubricating base oils of this invention. That is, the higher the kinematic viscosity at 100° C. in cSt the higher the amount of all molecules with at least one cycloparaffin function that are obtained. In a preferred embodiment the lubricating base oils have a weight percent of all molecules with at least cycloparaffin function greater than the kinematic viscosity in cSt multiplied by three, preferably greater than 15, more preferably greater than 20; and a ratio of weight percent of molecules containing monocycloparaffins to weight percent of molecules containing multicycloparaffins greater than 15, preferably greater than 50, more preferably greater than 100. The lubricating base oils have a kinematic viscosity at 100° C. between about 2 cSt and about 20 cSt, preferably between about 2 cSt and about 12 cSt. Examples of these base oils may have a kinematic viscosity at 100° C. of between about 2 cSt and about 3.3 cSt and have a weight percent of all molecules with at least one cycloparaffin function that is very high, but less than 10 weight percent.

The modified ASTM D 5292-99 and HPLC-UV test methods used to measure low level aromatics, and the FIMS test method used to characterize saturates are described in D.

C. Kramer, et al., "Influence of Group II & III Base Oil Composition on VI and Oxidation Stability," presented at the 1999 AIChE Spring National Meeting in Houston, Mar. 16, 1999, the contents of which is incorporated herein in its entirety.

Although the wax feeds of this invention are essentially free of olefins, base oil processing techniques can introduce olefins, especially at high temperatures, due to 'cracking' reactions. In the presence of heat or UV light, olefins can polymerize to form higher molecular weight products that can color the base oil or cause sediment. In general, olefins can be removed during the process of this invention by hydrofinishing or by clay treatment.

Base Oil Pour Factor

Figure 1:
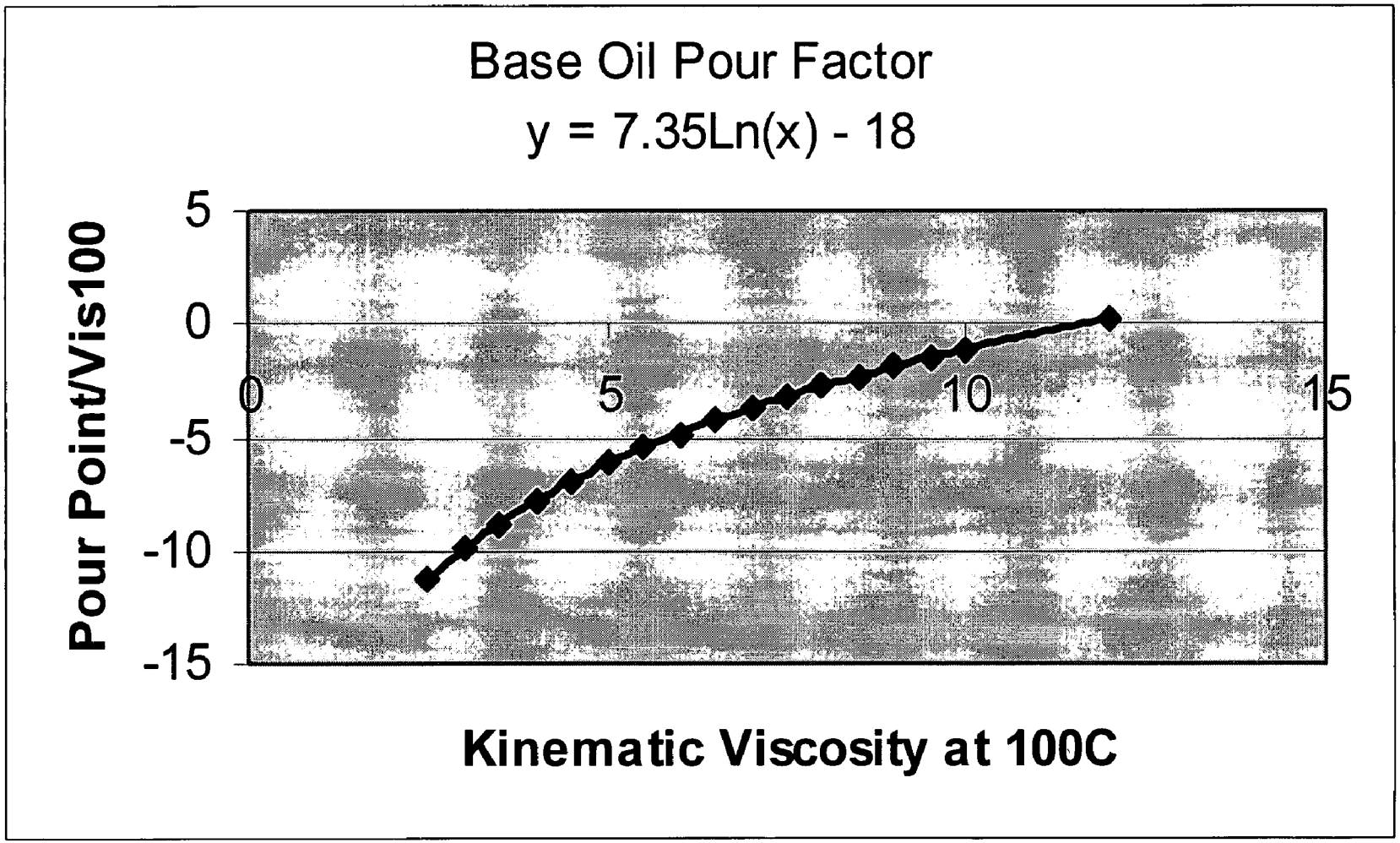
FIG. 1 illustrates the plot of Kinematic Viscosity at 100° C. in cSt vs. Pour Point in degrees Celsius/Kinematic Viscosity at 100° C. in cSt providing the equation for calculation of the Base Oil Pour Factor.

In preferred embodiments, the lubricating base oils of this invention have a ratio of pour point in degrees Celsius to kinematic viscosity at 100° C. in cSt greater than the Base Oil Pour Factor of said lubricating base oil. The Base Oil Pour Factor is a function of the kinematic viscosity at 100° C. and is calculated by the following equation: Base Oil Pour Factor=7.35×Ln(Kinematic Viscosity at 100° C.)−18, where Ln(Kinematic Viscosity) is the natural logarithm with base "e" of the kinematic viscosity at 100° C. measured in centistokes (cSt). The test method used to measure pour point is ASTM D 5950-02. The pour point is determined in one degree increments. The test method used to measure the kinematic viscosity is ASTM D 445-01. We show a plot of this equation in FIG. 1.

This relationship of pour point and kinematic viscosity in preferred embodiments of this invention also defines the preferred lower limit of pour point in degrees Celsius for each oil viscosity. For preferred examples of the lubricating base oils of this invention, the lower limit of pour point at a given kinematic viscosity at 100° C.=Base Oil Pour Factor×Kinematic Viscosity at 100° C. Thus the lower limit of pour point for a preferred 2.5 cSt lubricating base oil would be −28° C., for a preferred 4.5 cSt lubricating base oil would be −31° C., for a preferred 6.5 cSt lubricating base oil would be −28° C., and for a preferred 10 cSt lubricating base oil would be −11° C. By selecting for moderately low pour points we have oils that are not over-dewaxed that can be produced in high yields. In most cases the pour points of the lubricating base oils of this invention will be between −35° C. and +10° C.

In preferred embodiments, the high ratio of pour point to kinematic viscosity at 100° C. controls the pour point into a range that is moderately low, thus not requiring severe dewaxing. The severe dewaxing required to produce lubricating base oils with high cycloparaffins and very low pour points in the prior art decreased the ratio of monocycloparaffins to multicycloparaffins, and perhaps most importantly reduced the total yield of lubricating base oil and finished lubricant produced.

There is not necessarily a relationship between the Base Oil Pour Factor and desired cycloparaffin composition between base oils made by different manufacturing processes. Each desired property of the lubricating base oil of this invention should be selected for independently until a relationship may be determined for a specific manufacturing process.

The base oils of this invention respond favorably to the addition of conventional pour point depressants. Due to this favorable interaction it is not necessary to over dewax them to very low pour points at a yield disadvantage. With the addition of pour point depressant they may be blended into products meeting severe requirements for good low temperature properties, such as automotive engine oils.

Other Lubricating Base Oil Properties

Viscosity Index:

The viscosity indexes of the lubricating base oils of this invention will be high. In a preferred embodiment they will have viscosity indexes greater than 28×Ln(Kinematic Viscosity at 100° C.)+95. For example a 4.5 cSt oil will have a viscosity index greater than 137, and a 6.5 cSt oil will have a viscosity index greater than 147. In another preferred embodiment the viscosity indexes will be greater than 28×Ln(Kinematic Viscosity at 100° C.)+110. The test method used to measure viscosity index is ASTM D 2270-93(1998).

Aniline Point:

The aniline point of a lubricating base oil is the temperature at which a mixture of aniline and oil separates. ASTM D 611-01b is the method used to measure aniline point. It provides a rough indication of the solvency of the oil for materials which are in contact with the oil, such as additives and elastomers. The lower the aniline point the greater the solvency of the oil. Prior art lubricating base oils with a weight percent of all molecules with at least one aromatic function less than 0.30, made from substantially paraffinic wax feed having less than about 30 ppm total combined nitrogen and sulfur and hydroisomerization dewaxing, tend to have high aniline points and thus poor additive solubility and elastomer compatibility. The higher amounts of all molecules with at least one cycloparaffin function in the lubricating base oils of this invention reduce the aniline point and thus improve the additive solubility and elastomer compatibility. The aniline point of the lubricating base oils of this invention will tend to vary depending on the kinematic viscosity of the lubricating base oil at 100° C. in cSt.

In a preferred embodiment, the aniline point of the lubricating base oils of this invention will be less than a function of the kinematic viscosity at 100° C. Preferably, the function for aniline point is expressed as follows:

Aniline Point, ° F.<36×Ln (Kinematic Viscosity at 100° C.)+200. A plot of this equation is shown in FIG. 2.

Oxidation Stability:

Due to the extremely low aromatics and multicycloparaffins in the lubricating base oils of this invention their oxidation stability exceeds that of most lubricating base oils.

A convenient way to measure the stability of lubricating base oils is by the use of the Oxidator BN Test, as described by Stangeland et al. in U.S. Pat. No. 3,852,207. The Oxidator BN test measures the resistance to oxidation by means of a Dornte-type oxygen absorption apparatus. See R. W. Dornte "Oxidation of White Oils," Industrial and Engineering Chemistry, Vol. 28, page 26, 1936. Normally, the conditions are one atmosphere of pure oxygen at 340° F. The results are reported in hours to absorb 1000 ml of $O_2$ by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability. Traditionally it is considered that the Oxidator BN should be above 7 hours. For the present invention, the Oxidator BN value will be greater than about 30 hours, preferably greater than about 40 hours.

OLOA is an acronym for Oronite Lubricating Oil Additive®, which is a registered trademark of Chevron Oronite.

Noack Volatility:

Another important property of the lubricating base oils of this invention is low Noack volatility. Noack volatility is defined as the mass of oil, expressed in weight percent, which is lost when the oil is heated at 250 degrees C. and 20 mmHg (2.67 kPa; 26.7 mbar) below atmospheric in a test crucible through which a constant flow of air is drawn for 60 minutes (ASTM D 5800). A more convenient method for calculating Noack volatility and one which correlates well with ASTM D-5800 is by using a thermo gravimetric analyzer test (TGA) by ASTM D 6375-99a. TGA Noack volatility is used throughout this disclosure unless otherwise stated.

In preferred embodiments, the lubricating base oils of this invention have a Noack volatility less than an amount calculated from the equation: Noack Volatility, Wt %=1000×(Kinematic Viscosity at 100° C.)$^{-2.7}$, preferably less than an amount calculated from the equation: Noack Volatility, Wt %=900×(Kinematic Viscosity at 100° C.)$^{-2.8}$. Plots of these equations are shown in FIG. 3.

CCS Viscosity:

The lubricating base oils of this invention also have excellent viscometric properties under low temperature and high shear, making them very useful in multigrade engine oils. The cold-cranking simulator apparent viscosity (CCS VIS) is a test used to measure the viscometric properties of lubricating base oils under low temperature and high shear. The test method to determine CCS VIS is ASTM D 5293-02. Results are reported in centipoise, cP. CCS VIS has been found to correlate with low temperature engine cranking. Specifications for maximum CCS VIS are defined for automotive engine oils by SAE J300, revised in June 2001. The CCS VIS measured at −35° C. of the lubricating base oils of this invention are low, preferably less than an amount calculated by the equation: CCS VIS (−35° C.), cP=38×(Kinematic Viscosity at 100° C.)$^{3}$, more preferably less than an amount calculated by the equation: CCS VIS (−35° C.), cP=38×(Kinematic Viscosity at 100° C.)$^{2.8}$. Plots of these equations are shown in FIG. 4.

Elastomer Compatibility:

Lubricating base oils come into direct contact with seals, gaskets, and other equipment components during use. Original equipment manufacturers and standards setting organizations set elastomer compatibility specifications for different types of finished lubricants. Examples of elastomer compatibility tests are CEC-L-39-T-96, and ASTM D 4289-03. An ASTM standard entitled "Standard Test Method and Suggested Limits of Determining the Compatibility of Elastomer Seals for Industrial Hydraulic Fluid Applications" is currently in development. Elastomer compatibility test procedures involve suspending a rubber specimen of known volume in the lubricating base oil or finished lubricant under fixed conditions of temperature and test duration. This is followed at the end of the test by a second measurement of the volume to determine the percentage swell that has occurred. Additional measurements may be made of the changes in elongation at break and tensile strength. Depending on the rubber type and application, the test temperature may vary significantly. In preferred embodiments, the lubricating base oils of this invention are compatible with a broad number of types of elastomers, including but not limited to the following: neoprene, nitrile (acrylonitrile butadiene), hydrogenated nitrile, polyacrylate, ethylene-acrylic, silicone, chlor-sulfonated polyethylene, ethylene-propylene copolymers, epichlorhydrin, fluorocarbon, perfluoroether, and PTFE.

Lubricating Base Oil Manufacturing Plant:

Traditionally, lubricating base oil manufacturing plants were defined as either integrated or non-integrated. Integrated plants were linked to primary crude oil refineries and were fed with vacuum distillate by pipeline. Non-integrated plants purchased vacuum distillate on the open market or bought atmospheric residues and performed their own vacuum distillation. Often times they performed vacuum distillation on purchased crude oil.

The lubricating base oil manufacturing plants of this invention are not integrated with primary crude oil refineries in the traditional manner, but rather are integrated with plants that have a means to produce substantially paraffinic wax feed having less than about 30 ppm total combined nitrogen and sulfur, less than about 1 weight percent oxygen, greater than about 75 mass percent normal paraffin, less than 10 weight percent oil, a weight ratio of compounds having at least 60 or more carbon atoms and compounds having at least 30 carbon atoms less than 0.18, and a T90 boiling point between 660° F. and 1200° F. Examples of plants producing this type of wax feed are Fischer-Tropsch synthesis plants and plants capable of producing very highly refined slack waxes or pure n-paraffins.

The lubricating base oil manufacturing plants of this invention also have a means for hydroisomerization dewaxing using a shape selective intermediate pore size molecular sieve comprising a noble metal hydrogenation component, to produce an isomerized oil; and a means for hydrofinishing the isomerized oil to produce lubricating base oils having:

i. a weight percent aromatics less than 0.30;

ii. a weight percent total cycloparaffins greater than 10; and iii. a ratio of monocycloparaffins to multicycloparaffins greater than 15.

The lubricating base oil plants of this invention may also be integrated with a natural gas reformer that makes syngas to feed into a Fischer-Tropsch reactor. It may also be integrated with a blend plant that produces blended base oils or finished lubricants. Preferably, the lubricating base oil manufacturing plant of this invention will produce fuels in addition to lubricating base oils.

All of the publications, patents and patent applications cited in this application are herein incorporated by reference in their entirety to the same extent as if the disclosure of each individual publication, patent application or patent was specifically and individually indicated to be incorporated by reference in its entirety.

EXAMPLES

The following examples are included to further clarify the invention but are not to be construed as limitations on the scope of the invention.

Fischer-Tropsch Wax

Two commercial samples of hydrotreated Fischer-Tropsch wax made using a Fe-based Fischer-Tropsch synthesis catalyst (WOW8684 and NGQ9989) and three samples of hydrotreated Fischer-Tropsch wax made using a Co-based Fischer-Tropsch catalyst (WOW8782, WOW9107, and WOW9237) were analyzed and found to have the properties shown in Table I.

TABLE I

| | Fischer-Tropsch Wax | | | | |
|---|---|---|---|---|---|
| Fischer-Tropsch Catalyst | Fe-Based | Fe-Based | Co-Based | Co-Based | Co-Based |
| CVX Sample ID | WOW8684 | NGQ9989 | WOW8782 | WOW9107 | WOW9237 |
| Sulfur, ppm | | | 7, <2 | <6 | 2 |
| Nitrogen, ppm | 2, 4, 4, 1, 4, 7 | | 12, 19 | 6, 5 | 1.3 |
| Oxygen by Neutron Activation, Wt % | 0.15 | | 0.69 | 0.59 | 0.11 |
| GC N-Paraffin Analysis | | | | | |
| Total N Paraffin, Wt % | 92.15 | | 83.72 | 84.47 | |
| Avg. Carbon Number | 41.6 | | 30.7 | 27.3 | |
| Avg. Molecular Weight | 585.4 | | 432.5 | 384.9 | |
| D6352 SIMDIST TBP (Wt %) ° F. | | | | | |
| T0.5 | 784 | 10 | 129 | 515 | 450 |
| T5 | 853 | 131 | 568 | 597 | 571 |
| T10 | 875 | 181 | 625 | 639 | 621 |
| T20 | 914 | 251 | 674 | 689 | 683 |
| T30 | 941 | 309 | 717 | 714 | 713 |
| T40 | 968 | 377 | 756 | 751 | 752 |
| T50 | 995 | 437 | 792 | 774 | 788 |
| T60 | 1013 | 497 | 827 | 807 | 823 |
| T70 | 1031 | 553 | 873 | 839 | 868 |
| T80 | 1051 | 611 | 914 | 870 | 911 |
| T90 | 1081 | 674 | 965 | 911 | 970 |
| T95 | 1107 | 707 | 1005 | 935 | 1003 |
| T99.5 | 1133 | 744 | 1090 | 978 | 1067 |
| T90-T10, ° C. | 97 | 256 | 171 | 133 | 176 |
| Wt % C30+ | 96.9 | 0.00 | 40.86 | 34.69 | 39.78 |
| Wt % C60+ | 0.55 | 0.00 | 0.00 | 0.00 | 0.00 |
| C60+/C30+ | 0.01 | 0.00 | 0.00 | 0.00 | 0.00 |

The Fischer-Tropsch wax feeds were hydroisomerized over a Pt/SSZ-32 catalyst or Pt/SAPO-11 catalyst on an alumina binder. Run conditions were between 652 and 695° F. (344 and 368° C.), 0.6 to 1.0 LHSV, 300 psig or 1000 psig reactor pressure, and a once-through hydrogen rate of between 6 and 7 MSCF/bbl. For the majority of the samples the reactor effluent passed directly to a second reactor, also at 1000 psig, which contained a Pt/Pd on silica-alumina hydrofinishing catalyst. Conditions in that reactor were a temperature of 450° F. and LHSV of 1.0. Those samples which were not hydrofinished are indicated in the tables of properties that follow.

The products boiling above 650° F. were fractionated by atmospheric or vacuum distillation to produce distillate fractions of different viscosity grades. Test data on specific distillate fractions useful as lubricating base oils of this invention, and comparison samples, are shown in the following examples.

Lubricating Base Oils

Example 1, Example 2, and Comparative Example 3

Three lubricating base oils with kinematic viscosities below 3.0 cSt at 100° C. were prepared by hydroisomerization dewaxing Fischer-Tropsch wax and fractionating the isomerized oil into different distillate fractions. The properties of these samples are shown in Table II.

TABLE II

| Properties | Example 1 | Example 2 | Comparative Example 3 |
|---|---|---|---|
| CVX Sample ID | PGQ0118 | PGQ0117 | NGQ9637 |
| Wax Feed | NGQ9989 | NGQ9989 | WOW9107 |
| Hydroisomerization Temp, ° F. | 681 | 681 | 671 |
| Hydroisomerization Dewaxing Catalyst | Pt/SAPO-11 | Pt/SAPO-11 | Pt/SAPO-11 |
| Reactor Pressure, psig | 1000 | 1000 | 1000 |
| Viscosity at 100° C., cSt | 2.981 | 2.598 | 2.297 |
| Viscosity Index | 127 | 124 | 124 |
| Aromatics, wt % | 0.0128 | 0.0107 | |

TABLE II-continued

| Properties | Example 1 | Example 2 | Comparative Example 3 |
|---|---|---|---|
| FIMS, Wt % of Molecules | | | |
| Paraffins | 89.2 | 91.1 | 91.3 |
| Monocycloparaffins | 10.8 | 8.9 | 8.0 |
| Multicycloparaffins | 0.0 | 0.0 | 0.7 |
| Total | 100.0 | 100.0 | 100.0 |
| API Gravity | 43.4 | 44.1 | 44.69 |
| Pour Point, ° C. | −27 | −32 | −33 |
| Cloud Point, ° C. | −18 | −22 | −7 |
| Ratio of Mono/Multicycloparaffins | >100 | >100 | 11.4 |
| Ratio of Pour Point/Vis100 | −9.1 | −12.3 | −14.4 |
| Base Oil Pour Factor | −9.97 | −10.98 | −11.89 |
| Aniline Point, D 611, ° F. | 236.5 | 226.3 | |
| Noack Volatility, Wt % | 32.48 | 49.18 | |
| CCS Viscosity @ −35° C., cP | <900 | <900 | <900 |

Example 1 and Example 2 have low weight percents of all molecules with at least one aromatic function, high weight percents of all molecules with at least one cycloparaffin function, and a very high ratio of weight percent of molecules containing monocycloparaffins and weight percent of molecules containing multicycloparaffins. Note that Example 1 does not have greater than 10 weight percent of all molecules with at least one cycloparaffin function, but it does have a weight percent of all molecules with at least one cycloparaffin function greater than the kinematic viscosity at 100° C. multiplied by three. Example 1 also has a high ratio of pour point to kinematic viscosity at 100° C., meeting the properties of a preferred lubricating base oil of this invention. In addition the aniline points of Examples 1 and 2 fall below the line given by: 36×Ln(Kinematic Viscosity at 100° C.)+200. Comparative Example 3 has a slightly lower weight percent of all molecules with at least one cycloparaffin function. Comparative Example 3 also has a less desirable ratio of weight percent of molecules containing monocycloparaffins to weight percent of molecules containing multicycloparaffins, and a less preferred lower ratio of pour point to kinematic viscosity. These examples demonstrate that a low viscosity lubricating base oil of this invention, with a kinematic viscosity at 100° C. between 2 and about 3.3 cSt, may have less than 10 weight percent of all molecules with at least one cycloparaffin function, but a weight percent of all molecules with at least one cycloparaffin function greater than 3 times the kinematic viscosity at 100° C.

Example 4, Example 5, Example 6, and Example 7

Four lubricating base oils with kinematic viscosities between 4.0 and 5.0 cSt at 100° C. were prepared by hydroisomerization dewaxing Fischer-Tropsch wax and fractionating the isomerized oil into different distillate fractions. The properties of these samples are shown in Table III.

TABLE III

| Properties | Example 4 | Example 5 | Example 6 | Example 7 |
|---|---|---|---|---|
| CVX Sample ID | NGQ9712 | PGQ1118 | NGQ9608 | NGQ9939 |
| Wax Feed | WOW9107 | WOW9237 | WOW8782 | WOW8684 |
| Hydroisomerization Temp, ° F. | 673 | 652 | 700 | 682 |

TABLE III-continued

| Properties | Example 4 | Example 5 | Example 6 | Example 7 |
|---|---|---|---|---|
| Hydroisomerization Dewaxing Catalyst | Pt/SAPO-11 | Pt/SAPO-11 | Pt/SAPO-11 | Pt/SAPO-11 |
| Reactor Pressure, psig | 1000 | 300 | 1000 | 1000 |
| Viscosity at 100° C., cSt | 4.104 | 4.397 | 4.415 | 4.524 |
| Viscosity Index | 145 | 158 | 147 | 149 |
| Aromatics, wt % | 0.0086 | | | 0.0109 |
| FIMS, Wt % of Molecules | | | | |
| Paraffins | 88.4 | 79.8 | 89.1 | 89.4 |
| Monocycloparaffins | 11.6 | 21.2 | 10.9 | 10.4 |
| Multicycloparaffins | 0.0 | 0.0 | 0.0 | 0.2 |
| Total | 100.0 | 100.0 | 100.0 | 100.0 |
| API Gravity | 41.78 | | 41.6 | |
| Pour Point, ° C. | −20 | −31 | −12 | −17 |
| Cloud Point, ° C. | −9 | +3 | −8 | −10 |
| Ratio of Mono/Multicycloparaffins | >100 | >100 | >100 | 52 |
| Ratio of Pour Point/Vis100 | −4.87 | −7.05 | −2.72 | −3.76 |
| Base Oil Pour Factor | −7.62 | −7.12 | −7.09 | −6.91 |
| Oxidator BN, Hours | 40.78 | 26.0 | 41.35 | 34.92 |
| Aniline Point, D 611, ° F. | 249.6 | | | 253.2 |
| Noack Volatility, Wt % | 14.43 | | 10.89 | 12.53 |
| CCS Viscosity @ −35 C., cP | 1662 | | 2079 | 2090 |

Examples 4, 5, 6, and 7 all had the desired properties of the lubricating base oils of this invention. Examples 4 and 7 had exceptionally high oxidation stabilities, greater than 40 hours. Examples 4 and 7 also had low aniline points, which would provide desirable additive solubility and elastomer compatibility.

Example 8, Comparative Example 9, Example 10, and Example 11

Four lubricating base oils with kinematic viscosities between 6.0 and 7.0 at 100° C. were prepared by hydroisomerization dewaxing Fischer-Tropsch wax and fractionating the isomerized oil into different distillate fractions. The properties of these samples are shown in Table IV.

TABLE IV

| Properties | Example 8 | Comparative Example 9* | Example 10 | Example 11 |
|---|---|---|---|---|
| CVX Sample ID | NGQ9994 | NGQ9289 | NGQ9941 | NGQ9988 |
| Wax Feed | WOW8684 | WOW8684 | WOW8684 | WOW8684 |
| Hydroisomerization Temp, ° F. | 676 | 685 | 690 | 681 |

TABLE IV-continued

| Properties | Example 8 | Comparative Example 9* | Example 10 | Example 11 |
|---|---|---|---|---|
| Hydroisomerization Dewaxing Catalyst | Pt/SAPO-11 | Pt/SSZ-32* | Pt/SAPO-11 | Pt/SAPO-11 |
| Reactor Pressure, psig | 1000 | 1000 | 1000 | 1000 |
| Viscosity at 100° C., cSt | 6.26 | 6.972 | 6.297 | 6.295 |
| Viscosity Index | 158 | 153 | 153 | 154 |
| Aromatics, wt % | | 0.0898 | | 0.0141 |
| FIMS, Wt % of Molecules | | | | |
| Paraffins | 77.0 | 71.4 | 82.5 | 76.8 |
| Monocyclo-paraffins | 22.6 | 26.4 | 17.5 | 22.1 |
| Multicyclo-paraffins | 0.4 | 2.2 | 0.0 | 1.1 |
| Total | 100.0 | 100.0 | 100.0 | 100.0 |
| API Gravity | 40.3 | | 40.2 | 40.2 |
| Pour Point, ° C. | −12 | −41 | −23 | −14 |
| Cloud Point, ° C. | −1 | −2 | −6 | −6 |
| Ratio of Mono/Multi-cycloparaffins | 56.5 | 12.0 | >100 | 20.1 |
| Ratio of Pour Point/Vis100 | −1.92 | −5.89 | −3.65 | −2.22 |
| Base Oil Pour Factor | −4.52 | −3.73 | −4.48 | −4.48 |
| Aniline Point, D 611, ° F. | | | | 263 |
| Noack Volatility, Wt % | 2.3 | 5.5 | 2.8 | 3.19 |
| CCS Vis @ −35 C., cP | 5770 | 5993 | 4868 | 5002 |

*not hydrofinished

Examples 8, 10, and 11 are examples of lubricating base oils of this invention. Comparative Example 9 has a low ratio of molecules containing monocycloparaffins to molecules containing multicycloparaffins. In this comparative example, hydroisomerization dewaxing to produce a base oil with very low pour point was done with a yield disadvantage, and likely adversely impacted the ratio of weight percent of molecules containing monocycloparaffins to weight percent of molecules containing multicycloparaffins. Comparative Example 9 also had a higher Noack Volatility than the other oils of similar viscosity. Examples 8, 10, and 11 all had very low CCS VIS at −35° C., well below the amount calculated by 38×Ln(Kinematic Viscosity at 100° C.)$^{2.8}$.

Example 12, Comparative Example 13, Example 14, and Example 15

Four lubricating base oils with kinematic viscosities between 7.0 and 8.0 cSt at 100° C. were prepared by hydroisomerization dewaxing Fischer-Tropsch wax and fractionating the isomerized oil into different distillate fractions. The properties of these samples are shown in Table V.

TABLE V

| Properties | Example 12 | Comparative Example 13 | Example 14 | Example 15 |
|---|---|---|---|---|
| CVX Sample ID | NGQ9287 | NGQ9288 | NGQ9284 | NGQ9535 |
| Wax Feed | WOW8684 | WOW8684 | WOW8684 | WOW8782 |
| Hydroisomerization Temp, ° F. | 679 | 685 | 674 | 694 |
| Hydroisomerization Dewaxing Catalyst | Pt/SSZ-32 | Pt/SSZ-32 | Pt/SSZ-32 | Pt/SAPO-11 |
| Reactor Pressure, psig | 1000 | 1000 | 1000 | 1000 |
| Viscosity at 100° C., cSt | 7.182 | 7.023 | 7.468 | 7.953 |
| Viscosity Index | 159 | 155 | 170 | 165 |
| Aromatics, wt % | 0.0056 | 0.0037 | 0.0093 | |
| FIMS, Wt % of Molecules | | | | |
| Paraffins | 71.3 | 69.0 | 81.4 | 87.2 |
| Monocyclo-paraffins | 27.1 | 28.4 | 18.6 | 12.6 |
| Multicyclo-paraffins | 1.6 | 2.6 | 0.0 | 0.2 |
| Total | 100.0 | 100.0 | 100.0 | 100.0 |
| API Gravity | | | | 39.62 |
| Pour Point, ° C. | −27 | −33 | −9 | −12 |
| Cloud Point, ° C. | +6 | −4 | +10 | +13 |
| Ratio of Mono/Multi-cycloparaffins | 16.9 | 10.9 | >100 | 61 |
| Ratio of Pour Point/Vis100 | −3.76 | −4.70 | −1.21 | −1.51 |
| Base Oil Pour Factor | −3.51 | −3.67 | −3.22 | −2.76 |
| Noack Volatility | 4.9 | 5.4 | 4.3 | 2.72 |
| CCS Vis @ −35 C., cP | 5873 | 5966 | 7379 | 13627 |

Example 14 is a lubricating base oil of this invention with a particularly high viscosity index, greater than 28×Ln (Vis100)+110, and a particularly low CCS VIS at −35° C. Examples 12 and 15 also met the properties of this invention, although Example 15 did not meet the more preferred range of CCS viscosity at −35° C. (less than an amount calculated from the equation: CCS VIS(−35° C.)=38×(Kinematic Viscosity at 100° C.)$^{3}$. Comparative Example 13 did not meet the properties of this invention due to a low ratio of weight percent of molecules containing monocycloparaffins and weight percent of molecules containing multicycloparaffins. This may have occurred as a result of hydroisomerization dewaxing to a lower pour point in this example, which resulted in the formation of more multicycloparaffins.

Example 16

A lubricating base oil with a kinematic viscosity between 9.5 and 10.0 cSt at 100° C. was prepared by hydroisomerization dewaxing Fischer-Tropsch wax and fractionating the isomerized oil into different distillate fractions. The properties of this sample are shown in Table VI.

TABLE VI

| Properties | Example 16 |
|---|---|
| CVX Sample ID | PGQ0144 |
| Wax Feed | WOW8684 |
| Hydroisomerization Temp, ° F. | 669 |
| Hydroisomerization Dewaxing Catalyst | Pt/SAPO-11 |
| Reactor Pressure, psig | 1000 |
| Viscosity at 100° C., cSt | 9.679 |
| Viscosity Index | 168 |
| FIMS, Wt % of Molecules | |
| Paraffins | 84.4 |
| Monocycloparaffins | 14.7 |
| Multicycloparaffins | 0.9 |
| Total | 100.0 |
| Pour Point, ° C. | +1 |
| Cloud Point, ° C. | +26 |
| Ratio of Mono/Multicycloparaffins | 16.3 |
| Ratio of Pour Point/Vis100 | 0.10 |
| Base Oil Pour Factor | −1.32 |
| Oxidator BN, hours | 34.64 |
| Aniline Point, D611, ° F. | 280.3 |
| Noack Volatility | 0.9 |

Example 16 met the properties of the lubricating base oil of this invention, including high oxidation stability, low aniline point, and low Noack volatility. The Noack Volatility is less than the amount calculated from the equation:

$$\text{Noack Volatility, Wt \%} = 900 \times (\text{Kinematic Viscosity at } 100^\circ \text{ C.})^{-2.8}.$$

Comparative Example 17

(Run 951-15)

A hydrotreated Fischer-Tropsch wax (Table VII) was isomerized over a Pt/SSZ-32 catalyst which contained 0.3% Pt and 35% Catapal alumina binder. Run conditions were 560° F. hydroisomerization temperature, 1.0 LHSV, 300 psig reactor pressure, and a once-through hydrogen rate of 6 MSCF/bbl. The reactor effluent passed directly to a second reactor, also at 300 psig, which contained a Pt/Pd on silica-alumina hydrofinishing catalyst. Conditions in that reactor were a temperature of 450° F. and LHSV of 1.0. Conversion and yields, as well as the properties of the hydroisomerized stripper bottoms are given in Table VIII.

TABLE VII

| Inspections of Hydrotreated Fischer-Tropsch Wax | |
|---|---|
| Gravity, API | 40.3 |
| Nitrogen, ppm | 1.6 |
| Sulfur, ppm | 2 |
| Sim. Dist., Wt %, ° F. | |
| IBP/5 | 512/591 |
| 10/30 | 637/708 |
| 50 | 764 |
| 70/90 | 827/911 |
| 95/FBP | 941/1047 |

TABLE VIII

| Isomerization of FT Wax over Pt/SSZ-32 at 560° F., 1 LHSV, 300 psig, and 6 MSCF/bbl H2 | |
|---|---|
| Conversion <650° F., Wt % | 15.9 |
| Conversion <700° F., Wt % | 14.1 |

TABLE VIII-continued

| Isomerization of FT Wax over Pt/SSZ-32 at 560° F., 1 LHSV, 300 psig, and 6 MSCF/bbl H2 | |
|---|---|
| Yields, Wt % | |
| C1-C2 | 0.11 |
| C3-C4 | 1.44 |
| C5-180° F. | 1.89 |
| 180-290° F. | 2.13 |
| 290-650° F. | 21.62 |
| 650° F.+ | 73.19 |
| Stripper Bottoms: | |
| Yield, Wt % of Feed | 75.9 |
| Sim. Dist., LV %, ° F. | |
| IBP/5 | 588/662 |
| 30/50 | 779/838 |
| 95/99 | 1070/1142 |
| Pour Point, ° C. | +25 |

The stripper bottoms were solvent dewaxed using MEK/toluene at −15° C. The wax content was 33.9 wt %, and oil yield was 65.7 wt %. The solvent dewaxed 650° F.+oil yield, based on feed to the process, was 49.9 wt %. Inspections on this lubricating base oil are given below in Table IX.

TABLE IX

| Inspections of Hydroisomerized FT Wax after Solvent Dewaxing | Comparative Example 17 |
|---|---|
| Identification | 951-15 (455-479) |
| CVX Sample ID | PGQ1108 |
| Viscosity Index | 175 |
| Viscosity at 100° C., cSt | 3.776 |
| Pour Point, ° C. | −18 |
| Cloud Point, ° C. | −5 |
| Sim. Dist., LV %, ° F. | |
| IBP/5 | 608/652 |
| 10/30 | 670/718 |
| 50 | 775 |
| 70/90 | 890/953 |
| 95/FBP | 1004/1116 |
| FIMS, Wt % of Molecules | |
| Paraffins | 96 |
| Monocycloparaffins | 4 |
| Multicycloparaffins | 0 |
| Total | 100 |
| Oxidator BN, Hours | 31.87 |
| Ratio of Mono/Multicycloparaffins | >100 |
| Ratio of Pour Point/Vis100 | −4.77 |
| Base Oil Pour Factor | −8.23 |

Comparative Example 17 demonstrates that mild hydroisomerization dewaxing and subsequent solvent dewaxing produced a very low weight percent of all molecules with at least one cycloparaffin function. The hydroisomerization temperature was well below the desired range of about 600° F. to about 750° F. Although the Oxidator BN and the viscosity index of this oil was very high it would not have the preferred additive solubility and elastomer compatibility properties associated with the lubricating base oils of this invention with higher weight percents of all molecules with at least one cycloparaffin function. This example also points out that the Base Oil Pour Factor, although often associated with oils that meet the properties of the lubricating base oils of this invention can not be used independently of the other criteria (weight percent of all molecules with at least one cycloparaffin function and ratio of weight percent of molecules containing monocycloparaffins to weight percent of molecules containing multicycloparaffins, or high weight percent of molecules containing monocycloparaffins and low weight percent of molecules containing multicycloparaffins) to characterize the lubricating base oils of this invention.

Comparative Example 18 (Run 952-12)

An n-C36 feed (purchased from Aldrich) was isomerized over a Pt/SSZ-32 catalyst which contained 0.3% Pt and 35% Catapal alumina binder. Run conditions were hydroisomerization temperature of 580° F., 1.0 LHSV, 1000 psig reactor pressure, and a once-through hydrogen rate of 7 MSCF/bbl. The reactor effluent passed directly to a second reactor, also at 1000 psig, which contained a Pt/Pd on silica-alumina hydrofinishing catalyst. Conditions in that reactor were a temperature of 450° F. and LHSV of 1.0. Conversion and yields were as shown in Table X:

TABLE X

| | |
|---|---|
| Conversion <650° F., Wt % | 32.2 |
| Conversion <700° F., Wt % | 34.4 |
| Yields, Wt % | |
| C1-C2 | 0.45 |
| C3-C4 | 5.16 |
| C5-180° F. | 6.22 |
| 180-350° F. | 7.40 |
| 350-650° F. | 13.23 |
| 650° F.+ | 68.09 |

The hydroisomerized stripper bottoms from Run 952-12 had a pour point of +20° C. The stripper bottoms were solvent dewaxed using MEK/toluene at −15° C. The wax content was 31.5 wt %, and oil yield was 68.2 wt %. The solvent dewaxed 650° F.+oil yield, based on feed to the process, was 45.4 wt %. Inspections on this oil are summarized in Table XI.

Comparative Example 19 (Run FSL9497)

Run FSL9497 produced a lubricating base oil made from n-C28 feed (purchased from Aldrich) using a Pt/SSZ-32 catalyst (0.3 wt % Pt) bound with 35 wt % Catapal alumina. The run was at 1000 psig, 0.8 LHSV, and 7 MSCF/bbl once-through H2. Reactor hydroisomerization temperature was 575° F. The effluent from the reactor was subsequently passed over a Pt—Pd/SiO2-Al2O3 hydrofinishing catalyst at 450° F. and, other than temperature, the same conditions were used as in the isomerization reactor. The yield of 600° F.+ product was 71.5 wt %. The conversion of the wax to 600° F.− boiling range material was 28.5 wt %. The conversion below 700° F. was 33.6 wt %. The bottoms fraction from the run (75.2 wt %) was cut at 743° F. to give 89.2 wt % bottoms (67.1 wt % on the whole feed).

The hydroisomerized stripper bottoms had a pour point of +3° C. These bottoms were then solvent dewaxed at −15° C. to give 84.2 wt % solvent dewaxed oil (56.5 wt % on the whole feed), and 15.7 wt % wax. Inspections of the oil are shown in Table XI.

TABLE XI

| Properties | Comparative Example 18 | Comparative Example 19 |
|---|---|---|
| CVX Sample ID | PGQ1110 | PGQ1112 |
| Wax Feed | n-C36 | n-C28 |
| Viscosity at 100° C., cSt | 5.488 | 3.447 |
| Viscosity Index | 182 | 165 |
| FIMS, Wt % of Molecules | | |
| Paraffins | 98.3 | 100 |
| Monocycloparaffins | 1.7 | 0.0 |
| Multicycloparaffins | 0.0 | 0.0 |
| Total | 100.0 | 100.0 |
| Pour Point, ° C. | −9 | −15 |
| Aniline Point, D 611, ° F. | 261.9 | 245.1 |

Neither Comparative Example 18 nor Comparative Example 19 met the properties of this invention as they had very low weight percents of all molecules with at least one cycloparaffin function Neither of these base oils with low cycloparaffin content had aniline points as low as the base oils of this invention. Notably, they were both greater than 36×Ln(Kinematic Viscosity at 100° C.)+200, in ° F. These oils would be expected to have lower additive solubility and less desirable elastomer compatibility than the base oils of this invention. The hydroisomerization temperature was lower than the preferred range of about 600° F. to 750° F., which likely contributed to the lower amounts of cycloparaffins in both of these comparative examples.

Comparative Example 20 and Comparative Example 21

Two commercial Group III lubricating base oils were prepared using a waxy petroleum feed. The waxy petroleum feed had greater than about 30 ppm total combined nitrogen and sulfur and had a weight percent oxygen less than about 0.1. The feed was dewaxed by hydroisomerization dewaxing using Pt/SSZ-32 at a hydroisomerization dewaxing temperature between about 650° F. (343° C.) and about 725° F. (385° C.). They were both hydrofinished. The properties of these two samples are shown in Table XII.

TABLE XII

| Properties | Comparative Example 20 | Comparative Example 21 |
|---|---|---|
| Description | CVX UCBO 4R | CVX UCBO 7R |
| CVX Sample ID | WOW8047 | WOW8062 |
| Hydroisomerization Temp, ° F. | 600-750° F. | 600-750° F. |
| Hydroisomerization Dewaxing Catalyst | Pt/SSZ-32 | Pt/SSZ-32 |
| Viscosity at 100° C., cSt | 4.18 | 6.97 |
| Viscosity Index | 130 | 137 |
| Aromatics, wt % | 0.022 | 0.035 |
| FIMS, Wt % of Molecules | | |
| Paraffins | 24.6 | 24.8 |
| Monocycloparaffins | 43.6 | 51.2 |
| Multicycloparaffins | 31.8 | 24.0 |
| Total | 100.0 | 100.0 |
| API Gravity | 39.1 | 37.0 |
| Pour Point, ° C. | −18 | −18 |

TABLE XII-continued

| Properties | Comparative Example 20 | Comparative Example 21 |
|---|---|---|
| Cloud Point, ° C. | −14 | 5 |
| Ratio of Mono/Multicycloparaffins | 1.4 | 2.1 |
| Aniline Point, D 611, ° F. | 242.1 | 260.2 |

These two comparative examples demonstrate how lubricating base oils made with conventional waxy petroleum feeds, where the feeds contain high levels of sulfur and nitrogen, have high weight percents of all molecules with at least one cycloparaffin function. They also have low weight percents of all molecules with at least one aromatic function. However, they both have less desired very low ratios of weight percent of molecules containing monocycloparaffins to weight percent of molecules containing multicycloparaffins, much below the desired ratio of greater than 15 of the lubricating base oils of this invention. As a result, although they have aniline points similar to the lubricating base oils of this invention, they have lower viscosity indexes, below the desired level defined by the equation: VI=28×Ln (Kinematic Viscosity at 100° C.)+95.

What is claimed is:

1. A process for manufacturing a lubricating base oil, comprising the steps of:

a. performing a Fischer-Tropsch synthesis on syngas to provide a product stream;

b. isolating from said product stream a substantially paraffinic wax feed having:

i. less than about 30 ppm total combined nitrogen and sulfur, ii. less than about 1 weight percent oxygen, iii. a weight ratio of molecules having at least 60 or more carbon atoms and molecules having at least 30 carbon atoms less than 0.15, iv. and a T90 boiling point between 660° F. (349° C.) and 1200° F. (649° C.);

c. dewaxing said substantially paraffinic wax feed by hydroisomerization dewaxing using a shape selective intermediate pore size molecular sieve comprising a noble metal hydrogenation component, wherein the hydroisomerization temperature is between about 600° F. (315° C.) and about 750° F. (399° C.), whereby an isomerized oil is produced; and d. hydrofinishing said isomerized oil, whereby a lubricating base oil is produced having:

i. a weight percent of all molecules with at least one aromatic function less than 0.30;

ii. a weight percent of all molecules with at least one cycloparaffin function greater than 10; and iii. a ratio of weight percent of molecules containing monocycloparaffins to weight percent of molecules containing multicycloparaffins greater than 15.

2. The process of claim 1, wherein said substantially paraffinic wax feed has a T90 boiling point between 660° F. (349° C.) and 1200° F. (649° C.).

3. The process of claim 2, wherein said weight ratio of compounds having at least 60 or more carbon atoms and compounds having at least 30 carbon atoms is less than 0.10.

4. The process of claim 1, wherein said substantially paraffinic wax feed has a weight percent oxygen between 0.01 and 0.90 weight percent.

5. The process of claim 1, wherein said substantially paraffinic wax feed has a $C_{20}$+ fraction with an ASF chain growth probability between about 0.85 and about 0.915.

6. The process of claim 2, wherein the T90 boiling point is between 900° F. (482° C.) and 1200° F. (649° C.).

7. The process of claim 6, wherein the T90 boiling point is between 1000° F. (538° C.) and 1200° F. (649° C.).

8. The process of claim 1, wherein said substantially paraffinic wax feed has a difference between the T90 and T10 boiling points greater than 160° C.

9. The process of claim 8, wherein the difference between the T90 and T10 boiling points is greater than 200° C.

10. The process of claim 1, wherein said shape selective intermediate pore size molecular sieve is selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof.

11. The process of claim 10, wherein said shape selective intermediate pore size molecular sieve is selected from the group consisting of SAPO-11, SSZ-32, and combinations thereof.

12. The process of claim 1, wherein said noble metal hydrogenation component is platinum, palladium, or mixtures thereof.

13. The process of claim 1, wherein conversion of the compounds boiling above about 700° F. (370° C.) in the paraffinic waxy feed to compounds boiling below about 700° F. (370° C.) during the hydroisomerization dewaxing is maintained between about 10 wt % and 50 wt %.

14. The process of claim 13, wherein conversion of the compounds boiling above about 700° F. (370° C.) in the wax feed to compounds boiling below about 700° F. (370° C.) during the hydroisomerization dewaxing is maintained between about 15 wt % and 45 wt %.

15. The process of claim 1, wherein the dewaxing step is done prior to any optional solvent dewaxing.

16. The process of claim 1, further comprising hydrotreating said substantially paraffinic wax feed prior to hydroisomerization dewaxing.

17. The process of claim 1, further comprising fractionating the substantially paraffinic wax feed.

18. The process of claim 1, further comprising fractionating the lubricating base oil.

19. The process of claim 1, whereby the lubricating base oil has a ratio of monocycloparaffins to multicycloparaffins greater than 50.

20. The process of claim 1, whereby the lubricating base oil has a ratio of pour point to kinematic viscosity at 100° C. greater than the Base Oil Pour Factor as calculated by the following equation:

$$\text{Base Oil Pour Factor}=7.35\times\text{Ln}(\text{Kinematic Viscosity of said desired fraction at } 100^\circ\text{ C.})-18.$$

21. The process of claim 1, further comprising blending the lubricating base oil with an additional base oil selected from the group consisting of conventional Group I ease Oils, conventional Group II base oils, conventional Group III base oils, other GTL base oils, and mixtures thereof.

22. A process for manufacturing a lubricating base oil, comprising the steps of:

a. performing a Fischer-Tropsch synthesis on syngas to provide a product stream;

b. isolating from said product stream a substantially paraffinic wax feed having:

i. less than about 30 ppm total combined nitrogen and sulfur, ii. less than about 1 weight percent oxygen, and iii. a weight ratio of molecules having at least 60 or more carbon atoms and molecules having at least 30 carbon atoms less than 0.15;

c. dewaxing said substantially paraffinic wax feed by hydroisomerization dewaxing using a shape selective intermediate pore size molecular sieve comprising a noble metal hydrogenation component, wherein the hydroisomerization temperature is between about 600° F. (315° C.) and about 750° F. (399° C.), whereby an isomerized oil is produced; and d. hydrofinishing said isomerized oil, whereby a lubricating base oil is produced having:

i. a weight percent of all molecules with at least one aromatic function less than 0.30;

ii. a weight percent of all molecules with at least one cycloparaffin function greater than the kinematic viscosity at 100° C. in cSt multiplied by three; and iii. a ratio of weight percent molecules containing monocycloparaffins to weight percent of molecules containing multicycloparaffins greater than 15.

23. The process of claim 22, wherein said substantially paraffinic wax feed has a T90 boiling point between 660° F. (349° C.) and 1200° F. (649° C.).

24. The process of claim 23, wherein said weight ratio of compounds having at least 60 or more carbon atoms and compounds having at least 30 carbon atoms is less than 0.10.

25. The process of claim 22, wherein said substantially paraffinic wax feed has a weight percent oxygen between 0.01 and 0.90 weight percent.

26. The process of claim 22, wherein conversion of the compounds boiling above about 700° F. (370° C.) in the paraffinic waxy feed to compounds boiling below about 700° F. (370° C.) during the hydroisomerization dewaxing is maintained between about 10 wt % and 50 wt %.

27. The process of claim 22, further comprising hydrotreating said substantially paraffinic wax feed prior to hydroisomerization dewaxing.

28. The process of claim 22, whereby the ratio of weight percent of molecules containing monocycloparaffins to weight percent of molecules containing multicycloparaffins is greater than 50.

29. The process of claim 22, whereby the lubricating base oil has a ratio of pour point to kinematic viscosity at 100° C. greater than the Base Oil Pour Factor as calculated by the following equation:

$$\text{Base Oil Pour Factor} = 7.35 \times \text{Ln}(\text{Kinematic Viscosity at } 100^\circ\text{ C.}) - 18.$$

30. The process of claim 22, further comprising blending the lubricating base oil with an additional base oil selected from the group consisting of conventional Group I Base Oils, conventional Group II base oils, conventional Group III base oils, other GTL base oils, and mixtures thereof.

31. A lubricating base oil manufacturing plant, comprising:

a. a means to produce a substantially paraffinic wax feed having i. less than about 30 ppm total combined nitrogen and sulfur, ii. less than about 1 weight percent oxygen, iii. greater than about 75 mass percent normal paraffin, iv. less than 10 weight percent oil, v. a weight ratio of compounds having at least 60 or more carbon atoms and compounds having at least 30 carbon atoms less than 0.15, and vi. a T90 boiling point between 660° F. and 1200° F.;

b. a means for hydroisomerization dewaxing said substantially paraffinic wax feed using a shape selective intermediate pore size molecular sieve comprising a noble metal hydrogenation component, wherein the hydroisomerization temperature is between about 600° F. (315° C.) and about 750° F. (399° C.), to produce an isomerized oil, and c. a means for hydrofinishing the isomerized oil to produce lubricating base oils having:

i. a weight percent aromatics less than 0.30;

ii. a weight percent total cycloparaffins greater than 10; and iii. a ratio of weight percent molecules containing monocycloparaffins to weight percent molecules containing multicycloparaffins greater than 15.

* * * * *